US010363749B2

(12) United States Patent
Sato et al.

(10) Patent No.: US 10,363,749 B2
(45) Date of Patent: Jul. 30, 2019

(54) LIQUID DISCHARGING HEAD, LIQUID DISCHARGING APPARATUS, AND MANUFACTURING METHOD OF LIQUID DISCHARGING APPARATUS

(71) Applicant: SEIKO EPSON CORPORATION, Tokyo (JP)

(72) Inventors: Masahiko Sato, Matsumoto (JP); Hiroyuki Hagiwara, Matsumoto (JP); Hisashi Sato, Shiojiri (JP); Katsuhiro Okubo, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/022,615

(22) Filed: Jun. 28, 2018

(65) Prior Publication Data

US 2019/0001687 A1 Jan. 3, 2019

(30) Foreign Application Priority Data

Jun. 29, 2017 (JP) ..... 2017-127125
Jan. 30, 2018 (JP) ..... 2018-013727

(51) Int. Cl.
*B41J 2/175* (2006.01)
*B41J 2/14* (2006.01)
(Continued)

(52) U.S. Cl.
CPC ..... *B41J 2/17513* (2013.01); *B41J 2/14* (2013.01); *B41J 2/14233* (2013.01); *B41J 2/17596* (2013.01); *B41J 2/19* (2013.01); *B41J 2/195* (2013.01); *B41J 2002/14241* (2013.01); *B41J 2002/14419* (2013.01); *B41J 2202/20* (2013.01)

(58) Field of Classification Search
CPC . B41J 2/14; B41J 2/14233; B41J 2/175; B41J 2/17513; B41J 2/17523; B41J 2/17596; B41J 2/19; B41J 2/195; B41J 2002/14241; B41J 2002/14419; B41J 2202/20
See application file for complete search history.

(56) References Cited

U.S. PATENT DOCUMENTS 6,010,213 A * 1/2000 Kanaya ..... B41J 2/17513 141/351
6,350,014 B1 * 2/2002 Carlton ..... B41J 2/04 347/54

(Continued)

FOREIGN PATENT DOCUMENTS

JP 2014/184628 A 10/2014

*Primary Examiner* — Anh T Vo
(74) *Attorney, Agent, or Firm* — Workman Nydegger

(57) ABSTRACT

A liquid discharging head includes an external cover portion which is connected to a liquid discharging apparatus and which discharges a liquid from a nozzle, in which the external cover portion includes a first gas hole for communicating a first gas flow path which is provided inside the external cover portion with an atmosphere, a second gas hole for carrying a gas between a second gas flow path which is provided inside the external cover portion and the liquid discharging apparatus, and a first liquid hole for carrying the liquid between a liquid flow path which is provided inside the external cover portion and the liquid discharging apparatus, and in which the first gas hole and the second gas hole are disposed separately in the external cover portion.

20 Claims, 16 Drawing Sheets

(51) Int. Cl.
*B41J 2/195* (2006.01)
*B41J 2/19* (2006.01)

(56) References Cited

U.S. PATENT DOCUMENTS

| | | | | |
|---|---|---|---|---|
| 6,520,630 | B1 * | 2/2003 | Oda | B41J 2/17503 347/85 |
| 6,666,550 | B2 * | 12/2003 | Sasaki | B41J 2/17513 347/85 |
| 7,185,977 | B2 * | 3/2007 | Kyogoku | B41J 2/17513 347/86 |
| 2008/0246823 | A1 | 10/2008 | Comas et al. | |
| 2014/0285585 | A1 | 9/2014 | Yazaki et al. | |

* cited by examiner

LIQUID DISCHARGING HEAD, LIQUID DISCHARGING APPARATUS, AND MANUFACTURING METHOD OF LIQUID DISCHARGING APPARATUS

BACKGROUND

1. Technical Field

The present invention relates to a technology of discharging a liquid such as an ink.

2. Related Art

In a liquid discharging apparatus which is configured by installing a liquid discharging head, a liquid such as an ink and a gas for driving a valve body are carried between the liquid discharging head and the liquid discharging apparatus. In US-A-2008/0246823, a plurality of gas holes are provided in a coupling member of the liquid discharging apparatus side, gas holes of the liquid discharging head side are connected to the gas holes of the liquid discharging apparatus side, and the liquid discharging head is installed on the liquid discharging apparatus (refer to FIG. 7). Accordingly, the carrying of a gas between the liquid discharging head and the liquid discharging apparatus is possible.

However, in US-A-2008/0246823, there is a concern that a liquid will dribble into the gas hole. For example, in US-A-2008/0246823, since liquid holes are not formed in the coupling member, there is a concern that when connecting the liquid holes the dribbled liquid will enter the gas holes because it is necessary to separately connect the liquid holes. In particular, in US-A-2008/0246823, since the gas hole (vent hole) and the liquid hole (ink inlet) are at extremely close positions (refer to FIG. 4), the liquid easily dribbles into the gas hole when attaching and detaching the tube of the liquid hole. In US-A-2008/0246823, the single gas hole is used as both the gas hole for carrying the gas for driving the valve body in an air chamber and the gas hole for opening the air chamber to the atmosphere. Therefore, there is a concern that the dribbled liquid in the vicinity of the gas hole will be pushed into the gas hole when carrying the gas for driving the valve body.

SUMMARY

An advantage of some aspects of the invention is to suppress entrance of a liquid into a gas hole.

Aspect 1

According to an aspect of the invention, there is provided a liquid discharging head which includes an external cover portion which is connected to a liquid discharging apparatus and which discharges a liquid from a nozzle, in which the external cover portion includes a first gas hole for communicating a first gas flow path which is provided inside the external cover portion with an atmosphere, a second gas hole for carrying a gas between a second gas flow path which is provided inside the external cover portion and the liquid discharging apparatus, and a first liquid hole for carrying the liquid between a liquid flow path which is provided inside the external cover portion and the liquid discharging apparatus, and in which the first gas hole and the second gas hole are disposed separately in the external cover portion. In this configuration, since the first gas hole, the second gas hole, and the first liquid hole are provided on the external cover portion which is connected to the liquid discharging apparatus, it is possible to connect the second gas hole and the first liquid hole to the liquid discharging apparatus by connecting the external cover portion to the liquid discharging apparatus. Therefore, in comparison to a case in which the first liquid hole is connected to the liquid discharging apparatus separately from the external cover portion in which the first gas hole and the second gas hole are formed, it is possible to reduce the possibility that when connecting the first liquid hole the dribbled liquid will enter the first gas hole or the second gas hole when connecting the second gas hole. Accordingly, since the first gas hole for communicating with the atmosphere and the second gas hole for carrying the gas to and from the liquid discharging apparatus are disposed separately on the external cover portion, for example, when performing the carrying of the gas using the gas carrying mechanism, since the gas carrying mechanism is connected to the second gas hole instead of the first gas hole, it is possible to suppress the liquid which dribbled in the vicinity of the first gas hole being pushed into the first gas hole using the gas carrying mechanism. In this manner, according to the embodiment, it is possible to suppress the entrance of the liquid into the gas hole.

Aspect 2

In the liquid discharging head, the external cover portion may include a first surface, and the second gas hole and the first liquid hole may be disposed on the first surface. In this configuration, since the second gas hole and the first liquid hole are disposed on the first surface which is connected to the liquid discharging apparatus, it is possible to connect the second gas hole and the first liquid hole to the liquid discharging apparatus at once by connecting the external cover portion to the liquid discharging apparatus. Therefore, since the second gas hole is also connected when connecting the first liquid hole, it is possible to greatly reduce the possibility that the dribbled liquid from the first liquid hole will enter the second gas hole in comparison to a case in which the first liquid hole and the second gas hole are connected separately.

Aspect 3

In the liquid discharging head, the second gas hole and the first liquid hole may be arranged on a straight line. In this configuration, since the second gas hole and the first liquid hole are arranged on a straight line, it is easy to miniaturize in the direction which intersects the straight line.

Aspect 4

In the liquid discharging head, a level difference may be provided between the first gas hole and the first liquid hole. In this configuration, since the level difference is provided between the first gas hole and the first liquid hole, even if the liquid dribbles from the first liquid hole, the liquid does not easily move to the first gas hole. Therefore, it is possible to suppress the entrance of the liquid into the first gas hole when the first liquid hole is connected to the liquid discharging apparatus.

Aspect 5

In the liquid discharging head, the external cover portion may include a first surface and a second surface facing different directions from each other, and, of the first surface and the second surface, the first gas hole may be disposed on one and the first liquid hole may be disposed on the other. In this configuration, of the first surface and the second surface which face different directions from each other, since the first gas hole is disposed on one and the first liquid hole is disposed on the other, even if the liquid dribbles from the first liquid hole, the liquid does not easily move to the first gas hole. Therefore, it is possible to suppress the entrance of the liquid into the first gas hole when the first liquid hole is connected to the liquid discharging apparatus.

Aspect 6

The liquid discharging head may further include a second liquid hole for returning the liquid from the liquid discharging head to the liquid discharging apparatus, in which the first liquid hole and the second liquid hole may be arranged on a straight line, and in which the second liquid hole may be disposed at an end portion on the straight line. In this configuration, since the first liquid hole and the second liquid hole are arranged on the straight line and the second liquid hole is disposed at an end portion on the straight line, it is possible to simplify the routing of the flow path to which the second liquid hole is connected.

Aspect 7

The liquid discharging head may further include a second liquid hole for returning the liquid from the liquid discharging head to the liquid discharging apparatus, in which the external cover portion may include a first surface and a second surface facing different directions from each other, and in which, of the first surface and the second surface, the first liquid hole may be disposed on one and the second liquid hole is disposed on the other. In this configuration, of the first surface and the second surface which face different directions from each other, since the first liquid hole is disposed on one and the second liquid hole is disposed on the other, it is possible to simplify the routing of the flow path to which the second liquid hole is connected.

Aspect 8

In the liquid discharging head, a plurality of the second gas holes may be provided, the external cover portion may include a first surface, and the plurality of second gas holes may be disposed on the first surface. In this configuration, since a plurality of the second gas holes are disposed on the external cover portion, it is possible to carry the gas thereto. For example, it is possible to carry the gas at different timings for each of the second gas holes, and it is possible to selectively carry the gas from the plurality of second gas holes.

Aspect 9

In the liquid discharging head, a plurality of the first liquid holes may be provided, and the plurality of first liquid holes and the plurality of second gas holes may be disposed on the first surface. In this configuration, since the plurality of second gas holes and the plurality of first liquid holes are disposed on the first surface of the external cover portion, it is possible to connect the plurality of second gas holes and the plurality of first liquid holes to the liquid discharging apparatus at once. Therefore, since the second gas holes are also connected when connecting the first liquid holes, it is possible to greatly reduce the possibility that the dribbled liquid from any of the plurality of first liquid holes will enter any of the plurality of second gas holes in comparison to a case in which the plurality of first liquid holes and the plurality of second gas holes are connected separately.

Aspect 10

The liquid discharging head may further include a plurality of liquid discharge units which discharge the liquid, in which the first surface may include a plurality of regions corresponding to the plurality of liquid discharge units, in which the first liquid hole and the second gas hole may be disposed in each of the plurality of regions, and in which an interval between the first liquid hole and the second gas hole in a direction of the straight line in a predetermined region of the plurality of regions may be equal to an interval between the first liquid hole and the second gas hole in the direction of the straight line in the other regions. In this configuration, the interval between the first liquid hole and the second gas hole in a direction of the straight line in a predetermined region of the plurality of regions corresponding to the plurality of liquid discharge units is equal to the interval between the first liquid hole and the second gas hole in the direction of the straight line in the other regions. Therefore, it is possible to connect the liquid discharging head to any position on the liquid discharging apparatus side by providing a plurality of groups of holes on the liquid discharging apparatus which are connected to the first liquid holes and the second gas holes.

Aspect 11

The liquid discharging head may further include a check valve which communicates with the first liquid hole. In this configuration, since the liquid discharging head further includes the check valve which communicates with the first liquid hole, it is possible to suppress the liquid inside the liquid discharging head flowing out from the first liquid hole.

Aspect 12

According to another aspect of the invention, there is provided a liquid discharging apparatus which includes an apparatus main body to which the liquid discharging head is connected, in which the apparatus main body includes a main body-side second gas hole which is connected to the second gas hole, and a main body-side first liquid hole which connects to the first liquid hole, and in which the first gas flow path communicates with an atmosphere. In this configuration, it is possible to connect the liquid discharging head to the apparatus main body by connecting the second gas hole of the liquid discharging head to the main body-side second gas hole and connecting the first liquid hole of the liquid discharging head to the main body-side first liquid hole. It is possible to communicate the first gas flow path with the atmosphere on the apparatus main body side.

Aspect 13

According to still another aspect of the invention, there is provided a liquid discharging apparatus which includes an apparatus main body to which a first liquid discharging head and a second liquid discharging head which are different from each other are connected, in which the first liquid discharging head and the second liquid discharging head each include a gas hole for carrying a gas to and from the apparatus main body using a gas carrying mechanism, and a liquid hole for carrying the liquid to and from the apparatus main body using a liquid carrying mechanism, and in which the apparatus main body of the liquid discharging apparatus includes a main body-side gas hole which connects to the gas hole, and a main body-side liquid hole which connects to the liquid hole. In this configuration, since the gas holes and the liquid holes between the first liquid discharging head and the second liquid discharging head are provided on the external cover portion which can be connected to the apparatus main body, it is possible to connect the gas hole and the liquid hole of each of the liquid discharging heads to the liquid discharging apparatus by connecting the external cover portion of each of the liquid discharging heads to the liquid discharging apparatus. Therefore, in comparison to a case in which the liquid holes are connected to the liquid discharging apparatus separately from the external cover portion in which the first gas holes are formed, it is possible to reduce the possibility that when connecting the liquid holes the dribbled liquid will enter the gas holes. In this configuration, since it is possible to connect the gas holes and the liquid holes of the plurality of liquid discharging heads to the main body-side gas holes and the main body-side liquid holes, as long as the gas holes and the liquid holes are provided, it is possible to connect not only the same liquid discharging heads but also different liquid discharging heads to the apparatus main body while suppressing the entrance of the liquid to the gas holes.

Aspect 14

In the liquid discharging apparatus, the number of the gas holes of a predetermined liquid discharging head of the plurality of liquid discharging heads may be different from the number of gas holes of another liquid discharging head. In this configuration, even if liquid discharging heads having different numbers of gas holes are used, it is possible to connect the liquid discharging heads to the apparatus main body.

Aspect 15

In the liquid discharging apparatus, a position on the apparatus main body of a predetermined liquid discharging head of the plurality of liquid discharging heads may be different from a position on the apparatus main body of another liquid discharging head. In this configuration, even if liquid discharging heads having different positions with respect to the apparatus main body are used, it is possible to connect the liquid discharging heads to the apparatus main body.

Aspect 16

According to still another aspect of the invention, there is provided a manufacturing method of a liquid discharging apparatus which includes an apparatus main body to which a first liquid discharging head and a second liquid discharging head are connected, in which the first liquid discharging head and the second liquid discharging head are different from each other, in which the first liquid discharging head and the second liquid discharging head each include a gas hole for carrying a gas to and from the apparatus main body using a gas carrying mechanism, and a liquid hole for carrying the liquid to and from the apparatus main body using a liquid carrying mechanism, in which the apparatus main body of the liquid discharging apparatus includes a main body-side gas hole which connects to the gas hole, and a main body-side liquid hole which connects to the liquid hole, in which the manufacturing method includes removing one head of the first liquid discharging head and the second liquid discharging head which are installed in the apparatus main body and exchanging the removed head for another head, and in which in the exchanging, the liquid hole is connected to the main body-side liquid hole while the gas hole of the other head is connected to the main body-side gas hole. In this configuration, it is possible to easily manufacture the liquid discharging apparatus which is provided with the head which has a different overall configuration while suppressing the entrance of the liquid into the gas holes by exchanging one of the heads of the first liquid discharging head and the second liquid discharging head which are different from each other with the other head.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

Figure 1:
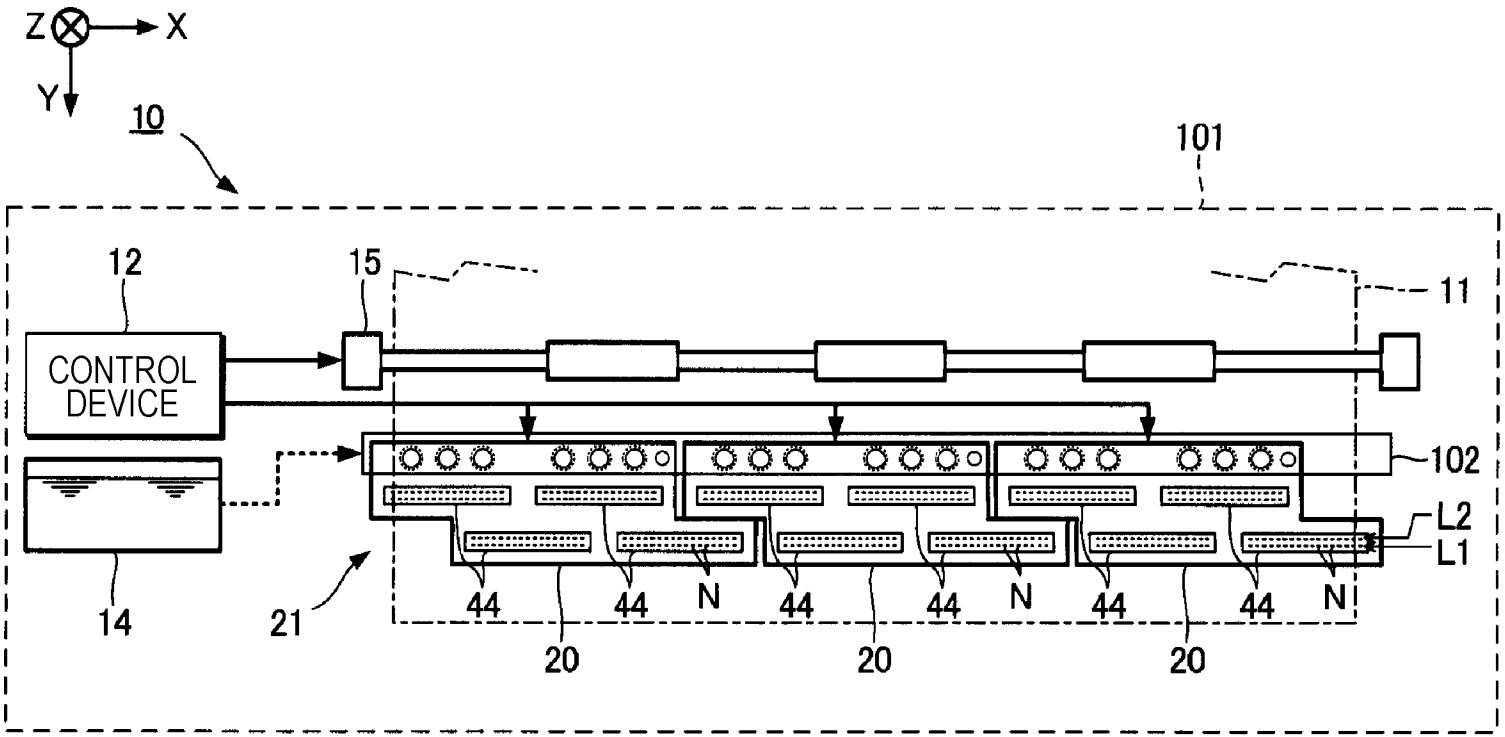
FIG. 1 is a configuration diagram of a liquid discharging apparatus according to a first embodiment.

FIG. 1 is a configuration diagram of a liquid discharging apparatus 10 according to an embodiment of the invention. The liquid discharging apparatus 10 of the embodiment is an ink jet type printing apparatus which discharges an ink which is an example of a liquid onto a medium 11 such as printing paper. An apparatus main body 101 of the liquid discharging apparatus 10 illustrated in FIG. 1 is provided with a control device 12 and a transport mechanism 15. The apparatus main body 101 is provided with a line head 21 which is configured by a plurality of exchangeable liquid discharging heads 20. A liquid container (a cartridge) 14 which stores the ink is installed on the apparatus main body 101 to be attachable and detachable.

The liquid container 14 is an ink tank type of liquid container which is formed from a box-shaped container which is attachable and detachable with respect to the main body of the liquid discharging apparatus 10. The liquid container 14 is not limited to being a box-shaped container and may be an ink pack type liquid container which is formed from a bag-shaped container. The ink is stored in the liquid container 14. The ink may be a black ink and may be a color ink. The ink which is stored in the liquid container 14 is pumped to the liquid discharging heads 20.

The control device 12 performs overall control of the elements of the liquid discharging apparatus 10. The transport mechanism 15 transports the medium 11 in a Y direction under the control of the control device 12. However, the configuration of the transport mechanism 15 is not limited to the examples given above. The liquid discharging heads 20 of the line head 21 discharge the ink which is supplied from the liquid container 14 onto the medium 11 under the control of the control device 12. The line head 21 of FIG. 1 exemplifies a case in which three of the liquid discharging heads 20 are installed on a main body side connecting portion 102 of the apparatus main body 101. The main body side connecting portion 102 of the embodiment has a block-shaped structure in which gas hole and liquid hole (described later) are formed. The liquid discharging heads 20 are arranged along an X direction which orthogonally intersects the Y direction which is the transport direction of the medium 11. A direction which is perpendicular to an X-Y plane (a plane which is parallel to the surface of the medium 11) will be denoted as a Z direction. The discharge direction of the ink by the liquid discharging heads 20 corresponds to the Z direction.

Liquid Discharging Head

Figure 2:
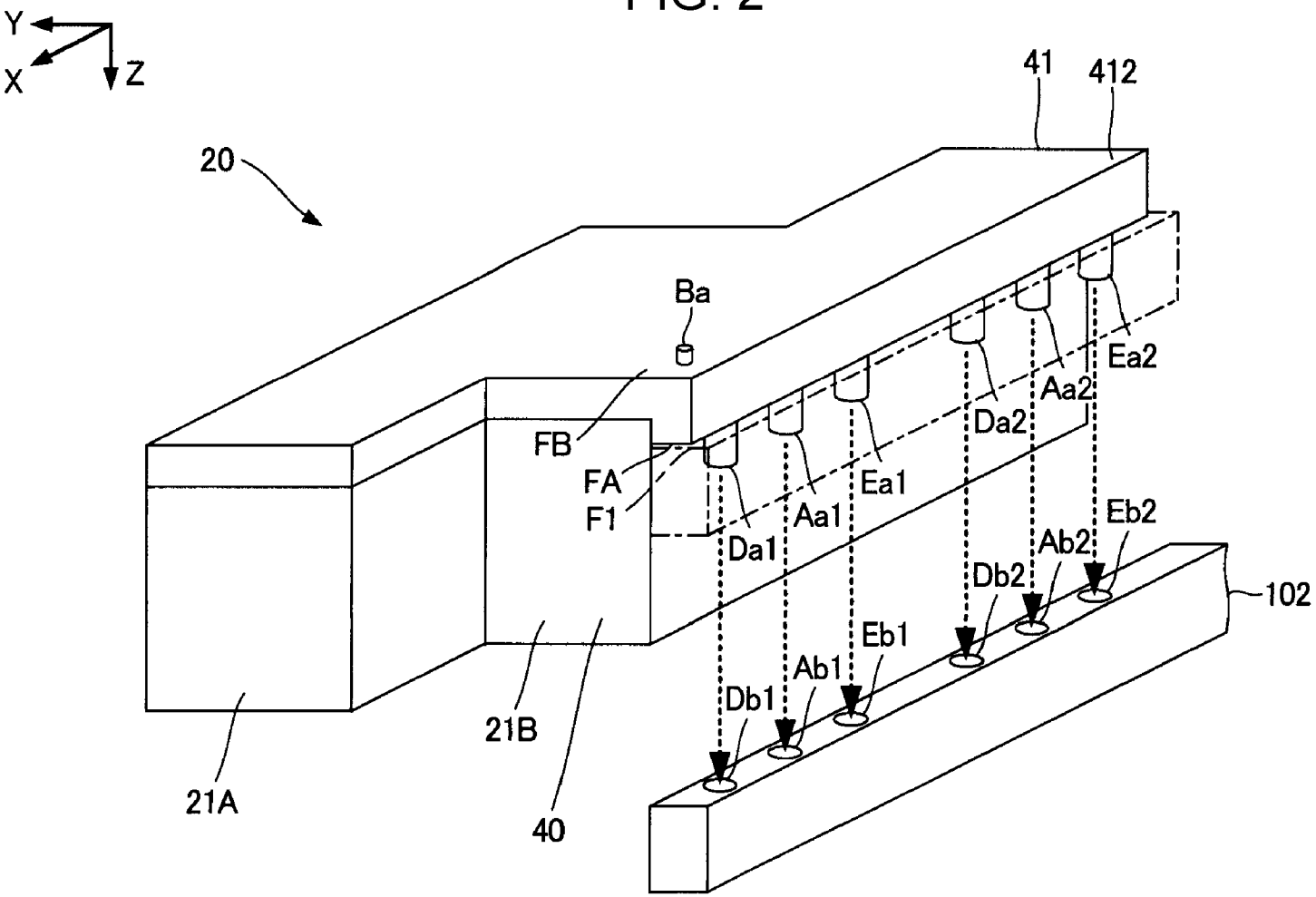
FIG. 2 is a perspective view illustrating an external configuration of one liquid discharging head from among those illustrated in FIG. 1.

FIG. 2 is a perspective view illustrating an external configuration of one of the liquid discharging heads 20 which configure the line head 21. In FIG. 2, the main body side connecting portion 102 before the liquid discharging head 20 is installed is indicated using a solid line and the main body side connecting portion 102 after the liquid discharging head 20 is installed is indicated using a dot-dash line. The liquid discharging head 20 of FIGS. 1 and 2 is provided with four liquid discharge units 44. Two rows containing two each of the liquid discharge units 44 are disposed. Specifically, the four liquid discharge units 44 are disposed in a staggered formation or a zigzag formation such that the positions of the liquid discharge units 44 are different in the X direction between a first row in which two of the liquid discharge units 44 are arranged and a second row in which two of the liquid discharge units 44 are arranged. The arrangement of the plurality of liquid discharge units 44 is not limited to that illustrated in FIG. 1, and for example, the liquid discharge units 44 may be disposed to line up along the Y direction.

The liquid discharging head 20 is configured such that two structural portions 21A and 21B, each having a box shape that is long in the X direction, deviate in the X direction and overlap each other. The two liquid discharge units 44 of the first row are provided in the structural portion 21A and the two liquid discharge units 44 of the second row are provided in the structural portion 21B. As illustrated in FIG. 2, the liquid discharging head 20 is provided with a head main body 40 and an external cover portion 41. The external cover portion 41 of the embodiment is disposed on the head main body 40 (the negative side in the Z direction) and functions as a block-shaped flow path structural body in which a liquid flow path D (an example of a liquid flow path) and a gas flow path A (an example of a second gas flow path) are formed. In the embodiment, a case is exemplified in which the head main body 40 of the structural portion 21A and the head main body 40 of the structural portion 21B are configured integrally and the external cover portion 41 of the structural portion 21A and the external cover portion 41 of the structural portion 21B are configured integrally. However, the configuration is not limited thereto and a configuration in which these are distinct may be adopted. The external cover portion 41 and the head main body 40 may be configured integrally.

Figure 3:
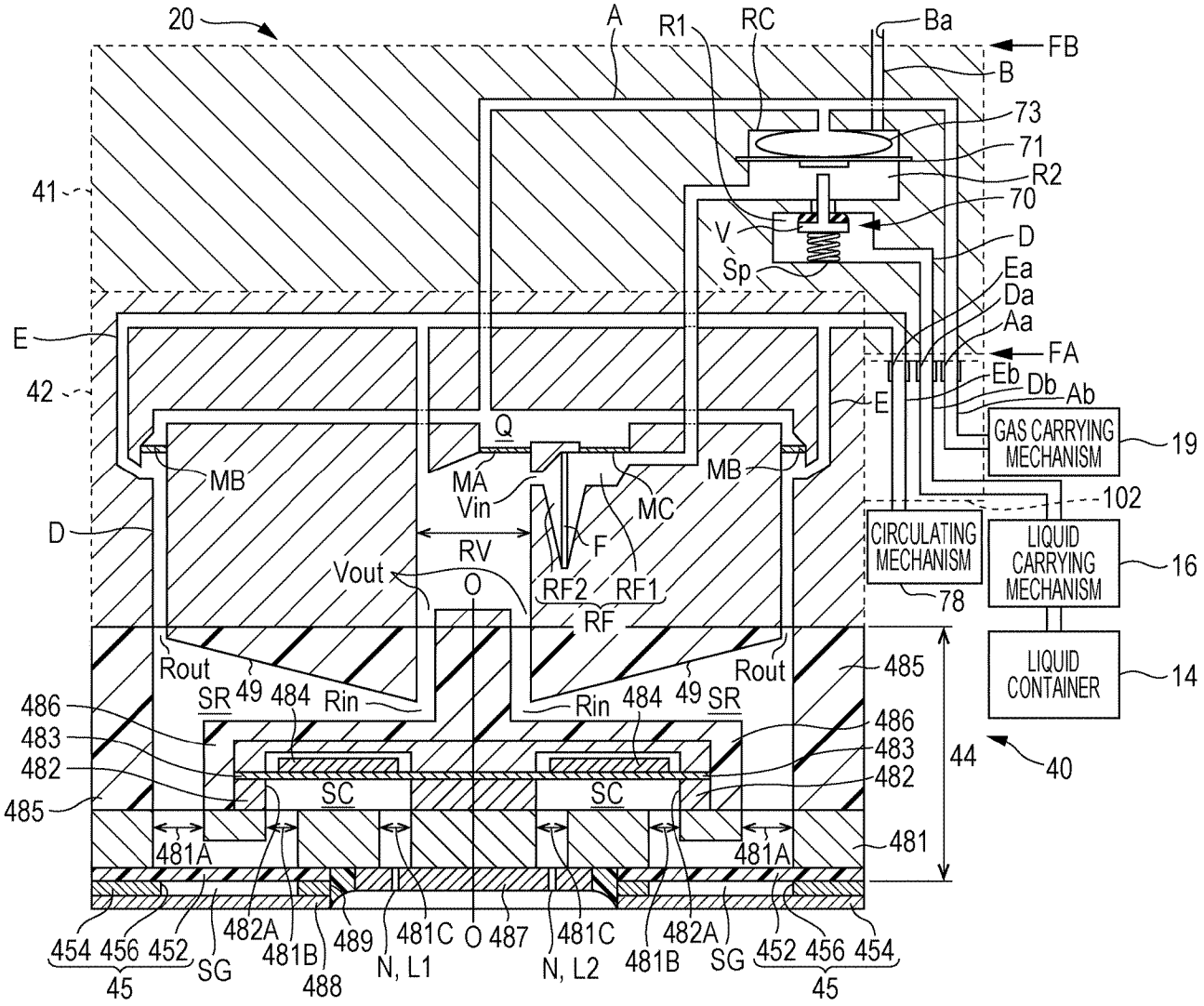
FIG. 3 is a functional configuration diagram of the liquid discharging head illustrated in FIG. 2.

FIG. 3 is a functional configuration diagram for explaining the internal configuration of the liquid discharging head 20 illustrated in FIG. 2. As illustrated in FIG. 3, the head main body 40 is provided with a flow path unit 42 and the liquid discharge unit 44. The liquid discharge unit 44 discharges the ink from a plurality of nozzles N. The flow path unit 42 is a structural body in the inner portion of which the liquid flow path D which supplies the ink to the liquid discharge unit 44 via the external cover portion 41 is formed. The liquid discharge unit 44 discharges the ink which is supplied from the liquid container 14 via the main body side connecting portion 102 and the flow path unit 42 onto the medium 11. The external cover portion 41 of the embodiment is configured as a valve body unit and contains an open-close valve 70 (described later) which controls the opening and closing of the liquid flow path D of the ink which is supplied from the main body side connecting portion 102.

The liquid discharge unit 44 is a structural body in which a pressure chamber substrate 482, a diaphragm 483, a piezoelectric element 484, a housing portion 485, and a sealing body 486 are disposed on one side of a flow path substrate 481, and a nozzle plate 487 and a compliance portion 45 are disposed on the other side. The flow path substrate 481, the pressure chamber substrate 482, and the nozzle plate 487 are formed by a silicon flat plate material, for example, and the housing portion 485 is formed by the extrusion molding of a resin material, for example. A plurality of nozzles N are formed in the nozzle plate 487. A surface of the nozzle plate 487 on an opposite side from the flow path substrate 481 corresponds to the discharge surface (a surface of the liquid discharge unit 44 facing the medium 11).

The plurality of nozzles N are divided into a first nozzle row L1 and a second nozzle row L2. Each of the first nozzle row L1 and the second nozzle row L2 is a collection of a plurality of nozzles N which are arranged along the Y direction. The first nozzle row L1 and the second nozzle row L2 are lined up with mutual intervals in the X direction. In the embodiment, the first nozzle row L1 and the second nozzle row L2 are disposed in a zigzag arrangement or a staggered arrangement such that the positions of the nozzles N of the first nozzle row L1 and the nozzles N of the second nozzle row L2 are different in the X direction.

In the liquid discharge unit 44 of FIG. 3, a structure corresponding to the first nozzle row L1 (the left-side portion of FIG. 3) and a structure corresponding to the second nozzle row L2 (the right-side portion of FIG. 3) are formed to be substantially symmetrical with respect to a virtual line O-O in the X direction and both of the two structures are practically shared. Therefore, hereinafter, a description will be given focusing mainly on the structure corresponding to the first nozzle row L1 (the left-side portion of the virtual line O-O of FIG. 3). An opening portion 481A, a branched flow path 481B, and a communicating flow path 481C are formed in the flow path substrate 481. The branched flow path 481B and the communicating flow path 481C are through holes which are formed for every nozzle N, and the opening portion 481A is an opening which continues along a plurality of the nozzles N.

A liquid storage chamber SR which serves as a shared liquid chamber (a reservoir) which communicates with the opening portion 481A of the flow path substrate 481 is formed in the housing portion 485. The liquid storage chamber SR of the left side of FIG. 3 is a space which stores the ink which is supplied to the plurality of nozzles N which configure the first nozzle row L1 and continues along the plurality of nozzles N. The liquid storage chamber SR of the right side of FIG. 3 is a space which stores the ink which is supplied to the plurality of nozzles N which configure the second nozzle row L2 and continues along the plurality of nozzles N. An inlet Rin into which the ink which is supplied from the upstream side flows is formed in each of the liquid storage chambers SR.

An opening portion 482A is formed for every nozzle N in the pressure chamber substrate 482. The diaphragm 483 is a flat plate material capable of elastic deformation which is installed on the surface of the pressure chamber substrate 482 on the opposite side from the flow path substrate 481. The space which is interposed between the diaphragm 483 and the flow path substrate 481 on the inside of each of the opening portions 482A of the pressure chamber substrate 482 functions as a pressure chamber (a cavity) SC which is filled with the ink which is supplied from the liquid storage chamber SR via the branched flow path 481B. Each of the pressure chambers SC communicates with a nozzle N via the communicating flow path 481C of the flow path substrate 481.

The piezoelectric element 484 is formed for every nozzle N on the surface of the diaphragm 483 on the opposite side from the pressure chamber substrate 482. Each of the piezoelectric elements 484 is a drive element in which a piezoelectric body is sandwiched between electrodes facing each other. When the diaphragm 483 vibrates due to the piezoelectric element 484 deforming according to the supply of a drive signal, the pressure inside the pressure chamber SC fluctuates and the ink inside the pressure chamber SC is discharged from the nozzle N. The sealing body 486 protects the plurality of piezoelectric elements 484. The piezoelectric elements 484 are connected to the control device 12 via a flexible printed circuit (FPC), a chip on film (COF), or the like which is not illustrated.

The compliance portion 45 of FIG. 3 is an element for suppressing pressure fluctuations in the ink inside the liquid storage chamber SR and includes a compliance substrate (an impingement baffle) 452 and a support plate 454. The compliance substrate 452 is a flexible member which is formed in a film shape and configures a portion of a wall surface (specifically, a floor surface) of the liquid storage chamber SR. The support plate 454 is a flat plate which is formed by a high rigidity material such as stainless steel (SUS) and supports the compliance substrate 452 on the surface of the flow path substrate 481 such that the liquid storage chamber SR and the opening portion 481A are blocked by the compliance substrate 452. An opening portion 456 is formed in the support plate 454 in a region which interposes the compliance substrate 452 and overlaps the liquid storage chamber SR. The space on the inside of the opening portion 456 of the support plate 454 communicates with the atmosphere and functions as a damper chamber SG for allowing the compliance substrate 452 to deform such that the pressure fluctuations in the liquid storage chamber SR and the opening portion 481A are absorbed.

The compliance portion 45 is fixed to a fixing plate 488. The fixing plate 488 is molded into a predetermined shape using a high rigidity material such as stainless steel, for example. A plurality of opening portions 489 corresponding to the nozzle plates 487 are formed in the fixing plate 488. The support plate 454 of the compliance portion 45 is fixed to the fixing plate 488 such that the nozzle plate 487 is exposed from the opening portion 489. The space on the inside of the opening portion 489 (specifically, the gap between the inner circumferential surface of the opening portion 489 and the outer circumferential surface of the nozzle plate 487) is filled with a filler material which is formed of a resin material, for example. The positive side of the Z direction of the opening portion 489 is closed by the fixing plate 488 and a space which is sandwiched between the compliance substrate 452 and the fixing plate 488 on the inside of the opening portion 489 forms the damper chamber SG. When the pumped ink is introduced into the liquid storage chamber SR, even if pressure fluctuation arises in the liquid storage chamber SR, it is possible to absorb the pressure fluctuation due to the compliance substrate 452 deforming.

Together with the external cover portion 41, the flow path unit 42 functions as a flow path structural body which is provided with the liquid flow path D and the gas flow path A. The liquid flow path D is a flow path which communicates to the nozzle N. The gas flow path A communicates with a bag-shaped body 73 of a pressurizing chamber RC which performs the control of the open-close valve 70 of the liquid flow path D and a decompression degassing chamber Q which performs the degassing (an operation of removing bubbles from the ink) of the liquid flow path D via gas-permeable membranes MA, MB, and MC.

First, a description will be given of the open-close valve 70 and the pressurizing chamber RC. An upstream side flow path R1 and a downstream side flow path R2 which configure a portion of the liquid flow path D, and the pressurizing chamber RC in which the bag-shaped body 73 which communicates with the gas flow path A is installed are formed in the inner portion of the external cover portion 41. The upstream side flow path R1 is connected to a liquid carrying mechanism 16 via a head-side connecting portion 412 and the main body side connecting portion 102. The liquid carrying mechanism 16 is a pump (a second pump) which carries (pumps) the ink which is stored in the liquid container 14 to the liquid discharging head 20 in a pressurized state. The open-close valve 70 is installed between the upstream side flow path R1 and the downstream side flow path R2 and a flexible film 71 is sandwiched between the downstream side flow path R2 and the pressurizing chamber RC.

The open-close valve 70 is a valve mechanism which opens and closes the liquid flow path D which supplies the ink to the liquid discharge unit 44. The open-close valve 70 is provided with a valve body V. The valve body V is provided between the upstream side flow path R1 and the downstream side flow path R2 and communicates (an open state) or blocks (a closed state) between the upstream side flow path R1 and the downstream side flow path R2. A spring Sp which biases the valve body V in a direction in which the upstream side flow path R1 and the downstream side flow path R2 are blocked is provided in the valve body V. Therefore, when a force is not acting on the valve body V, the upstream side flow path R1 and the downstream side flow path R2 are blocked. On the other hand, the upstream side flow path R1 and the downstream side flow path R2 are caused to communicate due to a force being applied to the valve body V against the biasing force of the spring Sp and the valve body V moving to the positive side in the Z direction.

The bag-shaped body 73 which is installed in the pressurizing chamber RC is a bag-shaped member which is formed by an elastic material such as rubber. The bag-shaped body 73 is connected to the gas flow path A, expands due to the pressurization of the gas flow path A and contracts due to decompression. The gas flow path A is connected to a gas carrying mechanism 19 via the head-side connecting portion 412 and the main body side connecting portion 102. The gas carrying mechanism 19 of the embodiment is a pump which carries the gas of the gas flow path A. Specifically, the gas carrying mechanism 19 is a pump (a first pump) capable of pressurizing and decompressing the gas flow path A, and is typically configured by a pneumatic pump. The gas carrying mechanism 19 may be configured by a single pump which is used for both the pressurizing and the decompression, and may be configured divided into a pump for pressurizing and a pump for decompression. It is not necessary for the entire surface of the bag-shaped body 73 to be an elastic material, and only one surface may be an elastic material as long as expansion is possible. A gas flow path B (the first gas flow path) for opening the pressurizing chamber RC to the atmosphere communicates with the pressurizing chamber RC.

In a state in which the bag-shaped body 73 is contracted, in a case in which the pressure inside the downstream side flow path R2 is maintained within a predetermined range, the valve body V is biased by the spring Sp and is pushed upward (the negative side in the Z direction) and the upstream side flow path R1 and the downstream side flow path R2 are blocked. On the other hand, when the pressure inside the downstream side flow path R2 is reduced to a numerical value which is lower than a predetermined threshold originating in the discharging of the ink by the liquid discharge unit 44 or suction from the outside, the valve body V moved downward (the positive side in the Z direction) against the biasing force of the spring Sp and the upstream side flow path R1 and the downstream side flow path R2 are communicated.

On the other hand, when the bag-shaped body 73 expands due to the pressurization by the gas carrying mechanism 19, the flexible film 71 pushes the valve body V down against the biasing force of the spring Sp according to the pressing by the bag-shaped body 73 and moves to the positive side in the Z direction. Therefore, the valve body V moves due to the pressing by the flexible film 71 and the open-close valve 70 is opened. In other words, it is possible to forcefully open the open-close valve 70 using the pressurizing by the gas carrying mechanism 19 regardless of the level of the pressure inside the downstream side flow path R2. Forcefully rendering the flexible film 71 movable using the pressurization by the gas carrying mechanism 19 to open the open-close valve 70 is exemplified by, for example, a case in which the liquid discharging head 20 is first filled with the ink (hereinafter referred to as "initial filling"), and a case in which the ink is discharged from the nozzle N during cleaning.

Next, a description will be given of the gas-permeable membranes MA, MB, and MC and the decompression degassing chamber Q. The filter chamber RF which communicates with a vertical space RV and the decompression degassing chamber Q are formed in the flow path unit 42. The decompression degassing chamber Q is a space for decompressing a portion of the liquid flow path D to remove bubbles from the ink. The decompression degassing chamber Q functions as a degassing space in which the bubbles (the gas) which are removed from the ink are temporarily retained. The decompression degassing chamber Q is configured by being divided into two spaces of a decompression chamber and a degassing chamber which communicate with each other, and may be provided with an open-close valve or a check valve in a communicating portion between the decompression chamber and the degassing chamber.

A filter F is provided in the filter chamber RF. The filter F is installed in the liquid discharge unit 44 to cross the liquid flow path D and gathers bubbles and foreign matter which are mixed into the ink. Specifically, the filter F is installed to partition a space RF1 and a space RF2. The space RF1 of the upstream side communicates with the downstream side flow path R2 of the external cover portion 41 and the space RF2 of the downstream side communicates with the vertical space RV.

The vertical space RV is a space for temporarily storing the ink. An inlet Vin into which the ink which passes the filter F flows from the space RF2 and an outlet Vout from which the ink flows out to the nozzle N side are formed in the vertical space RV. Compared to the outlet Vout, the inlet Vin is positioned above (the negative side in the Z direction) the outlet Vout in the vertical direction. In this configuration, the ink inside the space RF2 flows into the vertical space RV via the inlet Vin, and the ink inside the vertical space RV flows into the liquid storage chamber SR via the outlet Vout. The ink which flows into the liquid storage chamber SR is supplied to the pressure chambers SC via the opening portion 481A and is discharged from the nozzles N.

The gas-permeable membranes MA, MB, and MC are installed to partition a plurality of locations of the decompression degassing chamber Q and the liquid flow path D. However, the arrangement positions and the number of the gas-permeable membranes are not limited to those exemplified. The gas-permeable membrane MA is sandwiched between the vertical space RV and the decompression degassing chamber Q. The gas-permeable membrane MB is sandwiched between the liquid storage chamber SR and the decompression degassing chamber Q. The gas-permeable membrane MC is sandwiched between the space RF1 and the decompression degassing chamber Q. The gas-permeable membranes MA to MC are gas-permeable membranes (gas-liquid separation membranes) in which, although gas (air) is allowed to permeate, liquids such as ink are not allowed to permeate. The bubbles which are gathered by the filter F are discharged into the decompression degassing chamber Q and removed from the ink by permeating the gas-permeable membrane MC. The bubbles which permeate the filter F also flow into the vertical space RV via the inlet Vin from the space RF1 and flow into the vertical space RV. Therefore, the bubbles which flow into the vertical space RV are discharged into the decompression degassing chamber Q by permeating the gas-permeable membrane MA.

An output port Rout is formed in the liquid storage chamber SR. The output port Rout is a flow path which is formed in a ceiling surface 49 of the liquid storage chamber SR. The ceiling surface 49 of the liquid storage chamber SR is an inclined surface (a flat surface or a curved surface) which gets higher from the inlet Rin side to the output port Rout side. Therefore, the bubbles which enter from the inlet Rin are guided to the output port Rout side and discharged into the decompression degassing chamber Q by permeating the gas-permeable membrane MB.

Since the decompression degassing chamber Q communicates with the gas flow path A, the decompression degassing chamber Q is decompressed due to the gas flow path A being decompressed by the gas carrying mechanism 19. When the decompression degassing chamber Q is decompressed, the bubbles in the liquid flow path D pass through the gas-permeable membranes MA, MB, and MC. The gas which passes through the gas-permeable membranes MA, MB, and MC and moves into the decompression degassing chamber Q passes through the gas flow path A and is discharged to the outside of the apparatus. In this manner, the bubbles are removed from the liquid flow path D.

The liquid flow path D of the embodiment includes a liquid flow path E for returning the ink of the liquid discharging head 20 to the liquid discharging apparatus 10 side. The liquid flow path E is a path which communicates with the inner portion flow path of the flow path unit 42 (specifically, a flow path for supplying the ink to the liquid discharge unit 44). Specifically, the liquid flow path E communicates the output port Rout and the vertical space RV of the liquid storage chamber SR of each of the liquid discharge units 44 with each other. The liquid flow path E is connected to a circulating mechanism 78 via the external cover portion 41 and the main body side connecting portion 102. The circulating mechanism 78 is provided with a circulation path, a pump, and the like, and has a function of causing the ink which is discharged from the liquid flow path E to circulate such that the ink returns to the liquid discharging apparatus 10 side and can be used again by the liquid discharging head 20.

As illustrated in FIGS. 2 and 3, the external cover portion 41 is provided with the head-side connecting portion 412 which is connected to the flow path unit 42 and is capable of connecting to the main body side connecting portion 102 of the apparatus main body 101. The head-side connecting portion 412 is disposed to overhang in the X direction from the side surface of the flow path unit 42. In the embodiment, a first surface FA which is a surface (the bottom surface in FIG. 3) of the positive side of the head-side connecting portion 412 in the Z direction is connected to a connecting surface F1 (the top surface in FIG. 3) of the main body side connecting portion 102. Although the first surface FA and the connecting surface F1 are connected such that a gap is formed in the Z direction, a gap may not be formed.

The head-side connecting portion 412 is provided with a gas hole Ba (an example of a first gas hole) which communicates with the gas flow path B (an example of a first gas flow path), and a gas hole Aa (an example of a second gas hole) which communicates with the gas flow path A (an example of a second gas flow path). The head-side connecting portion 412 is provided with a liquid hole Da (an example of a first liquid hole) which communicates with the liquid flow path D (an example of a first liquid flow path), and a liquid hole Ea (an example of a second liquid hole) which communicates with the liquid flow path E (an example of a second liquid flow path). On the other hand, the main body side connecting portion 102 is provided with a main body-side gas hole Ab for connecting to the gas hole Aa, a main body-side liquid hole Db for connecting to the liquid hole Da, and a main body-side liquid hole Eb for connecting to the liquid hole Ea. As illustrated in FIG. 3, the gas carrying mechanism 19 is connected to the main body-side gas hole Ab, the liquid carrying mechanism 16 is connected to the main body-side liquid hole Db, and the circulating mechanism 78 is connected to the main body-side liquid hole Eb. However, as long as the gas flow path B can be opened to the atmosphere, the main body-side gas hole Ba need not be present.

In this configuration, due to connecting the liquid discharging head 20 to the apparatus main body 101 such that the head-side connecting portion 412 is connected to the main body side connecting portion 102, it is possible to connect the gas hole Aa which communicates with the gas flow path A to the main body-side gas hole Ab separately from the gas hole Ba which communicates with the gas flow path B.

Hypothetically, if the gas hole Ba and the gas hole Aa are the same single hole, when pressurizing the gas flow path A using the gas carrying mechanism 19, there is a concern that the dribbled ink in the vicinity of the single hole will be pushed into the inner portion of the gas flow path B by the gas carrying mechanism 19. When the ink enters the inner portion of the gas flow path B, there is a concern that the gas flow path B will be blocked by solidification of the ink. With regard to this point, in the embodiment, since the gas hole Ba for communicating with the atmosphere and the gas hole Aa which is connected to the gas carrying mechanism 19 are disposed separately in the head-side connecting portion 412, it is possible to suppress the pushing of the dribbled ink in the vicinity of the gas hole Ba into the inner portion of the gas flow path B by the gas carrying mechanism 19.

In this configuration of the embodiment, the gas hole Aa, the liquid hole Da, and the liquid hole Ea are each connected once to the main body-side gas hole Ab, the main body-side liquid hole Db, and the main body-side liquid hole Eb. Therefore, it is possible to suppress the ink dribbling from the liquid hole Da or the liquid hole Ea and entering the gas hole Aa.

Hypothetically, if the gas hole Aa, the liquid hole Da, and the liquid hole Ea are each separately connected to the main body-side gas hole Ab, the main body-side liquid hole Db, and the main body-side liquid hole Eb, there is a concern that the ink will dribble and enter the gas hole Aa when connecting the liquid hole Da and the liquid hole Ea to the main body-side liquid hole Db and the main body-side liquid hole Eb. Regarding this point, in the embodiment, since it is possible to connect each of the gas hole Aa, the liquid hole Da, and the liquid hole Ea to the main body-side gas hole Ab, the main body-side liquid hole Db, and the main body-side liquid hole Eb at once, it is possible to ensure that the ink does not easily dribble from the liquid hole Da or the liquid hole Ea, and even if the ink does dribble, since the gas hole Aa is connected to the main body-side gas hole Ab, the dribbled ink does not easily enter the gas hole Aa.

Figure 4:
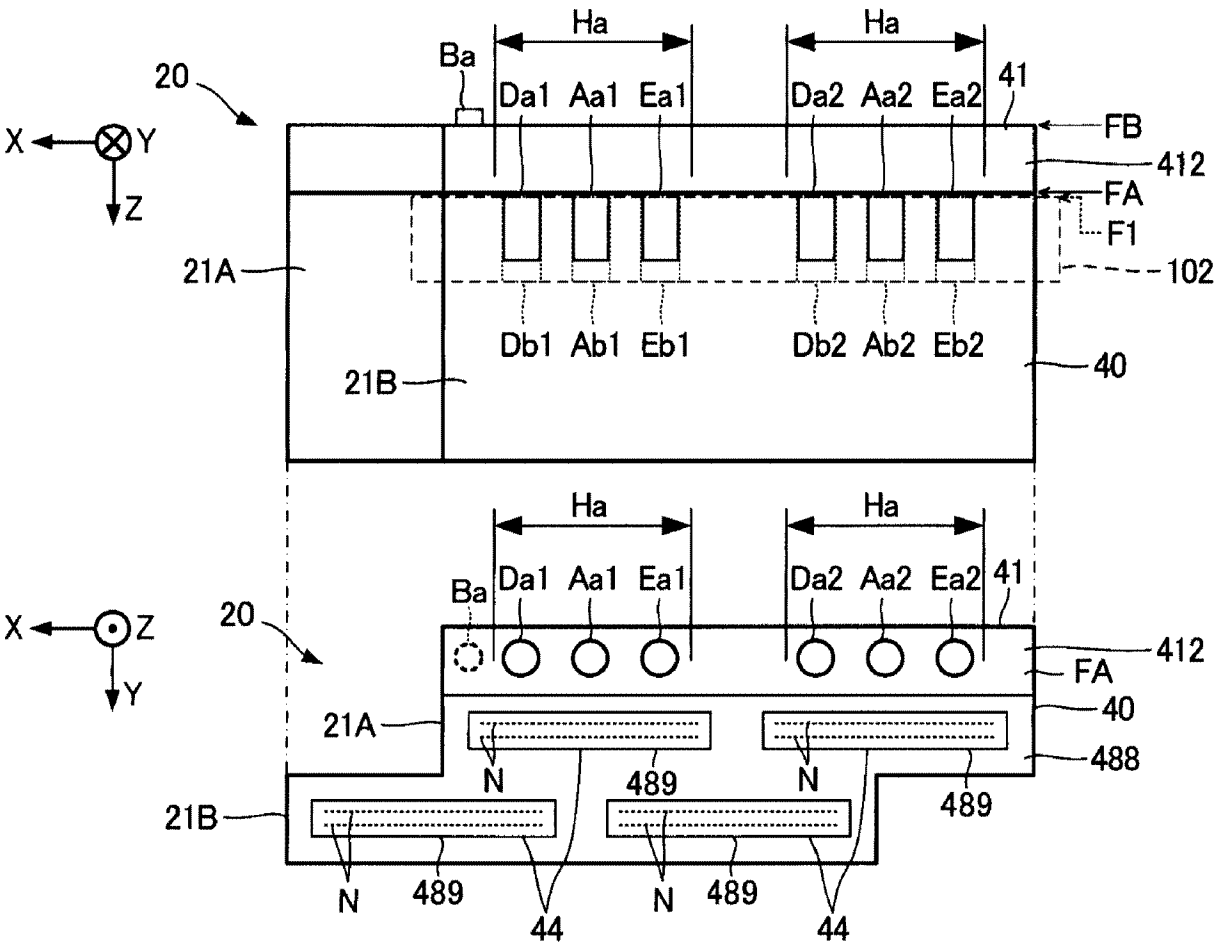
FIG. 4 shows a side view and a bottom view of the liquid discharging head illustrated in FIG. 3.

FIG. 4 shows a side view and a bottom view of the liquid discharging head 20. The side view of FIG. 4 (the view of the top side of FIG. 4) is a diagram of the liquid discharging head 20 as viewed from the head-side connecting portion 412 side. The bottom view of FIG. 4 (the view of the bottom side of FIG. 4) is a diagram of the liquid discharging head 20 as viewed from the fixing plate 488 side. In the side view of FIG. 4, a portion of the main body side connecting portion 102 to which the head-side connecting portion 412 is connected is depicted using a dotted line.

In the liquid discharging head 20 of FIG. 4, the gas hole Aa, the liquid hole Da, and the liquid hole Ea which are shared by two liquid discharge units 44 of the four liquid discharge units 44 are each a gas hole Aa1, a liquid hole Da1, and a liquid hole Ea1. The gas hole Aa, the liquid hole Da, and the liquid hole Ea which are shared by the other two liquid discharge units 44 are each a gas hole Aa2, a liquid hole Da2, and a liquid hole Ea2. The gas hole Aa1, the liquid hole Da1, and the liquid hole Ea1 of the head-side connecting portion 412 are connected to a main body-side gas hole Ab1, a main body-side liquid hole Db1, and a main body-side liquid hole Eb1 of the main body side connecting portion 102, respectively. The gas hole Aa2, the liquid hole Da2, and the liquid hole Ea2 of the head-side connecting portion 412 face and are connected to a main body-side gas hole Ab2, a main body-side liquid hole Db2, and a main body-side liquid hole Eb2 of the main body side connecting portion 102, respectively.

In FIG. 4, a case is exemplified in which each of the gas holes Aa1 and Aa2 and each of the liquid holes Da1, Da2, Ea1, and Ea2 is formed as a tubular or needle-shaped protrusion which is provided on the surface of the head-side connecting portion 412 and the main body-side gas holes Ab1 and Ab2 and the main body-side liquid holes Db1, Db2, Eb1, and Eb2 are formed on the surface of the main body side connecting portion 102 as insertion holes into which the protrusions are inserted. The holes Aa1, Aa2, Da1, Da2, Ea1, and Ea2 of the head-side connecting portion 412 are connected to the holes Ab1, Ab2, Db1, Db2, Eb1, and Eb2 of the main body side connecting portion 102, respectively by inserting the protrusions into the insertion holes. However, the configuration is not limited thereto, and a configuration may be adopted in which the main body-side gas holes Ab1 and Ab2 and the main body-side liquid holes Db1, Db2, Eb1, and Eb2 are the ones formed as tubular or needle-shaped protrusions, and the gas holes Aa1 and Aa2 and the liquid holes Da1, Da2, Ea1, and Ea2 are insertion hole.

The plurality of gas holes Aa1 and Aa2 and the plurality of liquid holes Da1, Da2, Ea1, and Ea2 are all disposed on the same first surface FA. On the other hand, the main body-side gas holes Ab1 and Ab2 and the plurality of main body-side liquid holes Db1, Db2, Eb1, and Eb2 which are connected to the plurality of gas holes Aa1 and Aa2 and the plurality of liquid holes Da1, Da2, Ea1, and Ea2, respectively, are disposed on the connecting surface F1 which faces the first surface FA.

According to the configuration of FIG. 4, when connecting the external cover portion 41 to the apparatus main body 101, by connecting the head-side connecting portion 412 to the main body side connecting portion 102, it is possible to connect the gas holes Aa1 and Aa2 and the liquid holes Da1, Da2, Ea1, and Ea2 to the main body-side gas holes Ab1 and Ab2 and the main body-side liquid holes Db1, Db2, Eb1, and Eb2, respectively, at once. Therefore, when the external cover portion 41 of the liquid discharging head 20 is connected to the apparatus main body 101, it is possible to suppress the ink dribbling from the liquid holes Da1, Da2, Ea1, and Ea2 and entering the gas holes Aa1 and Aa2.

Hypothetically, in a case in which the liquid holes Da1, Da2, Ea1, and Ea2 are connected to the main body side connecting portion 102 separately from the external cover portion 41 in which the gas holes Aa1 and Aa2 are formed, there is a possibility that when the ink dribbles during connecting any of the liquid holes Da1, Da2, Ea1, and Ea2, when connecting the external cover portion 41, the dribbled ink will enter one of the gas holes Aa1 and Aa2. Regarding this point, according to the configuration of FIG. 4, if the head-side connecting portion 412 of the external cover portion 41 is connected to the main body side connecting portion 102, since the liquid holes Da1, Da2, Ea1, and Ea2 and the gas holes Aa1 and Aa2 are connected at once, when the liquid holes Da1, Da2, Ea1, and Ea2 are connected, the gas holes Aa1 and Aa2 are also connected. Regarding this point, according to the configuration of FIG. 4, in comparison to a case in which the liquid holes Da1, Da2, Ea1, and Ea2 are connected separately from the gas holes Aa1 and Aa2, it is possible to greatly reduce the possibility of the dribbled ink from any of the liquid holes Da1, Da2, Ea1, and Ea2 entering either of the gas holes Aa1 and Aa2.

In the configuration of FIG. 4, since the plurality of gas holes Aa1 and Aa2 are disposed in the external cover portion 41, it is possible to carry the gas thereto. Since the plurality of gas holes Aa1 and Aa2 are connected separately to the gas flow path A, for example, it is possible to carry the gas at different timings for each of the gas holes, and it is possible to selectively carry the gas from the plurality of gas holes Aa1 and Aa2. In a case in which the gas is selectively carried, even if the ability of the pump is not high, it becomes easier to pressurize and decompress the gas flow path A by a desired amount.

In FIG. 4, although a case is exemplified in which the gas holes and the liquid holes are disposed on the same surface of the first surface FA, the configuration is not limited thereto, and the first surface FA may be configured by a plurality of surfaces having level differences and inclinations and the gas holes and the liquid holes may be disposed separately on the plurality of surfaces. By providing a level difference between the gas holes and the liquid hole, even if the ink dribbles from the liquid holes, the ink does not easily move to the gas holes. Therefore, it is possible to suppress the entrance of the ink into the gas holes when the liquid holes are connected to the apparatus main body 101.

The gas hole Ba for opening the liquid discharging head 20 to the atmosphere of FIG. 4 is disposed on another second surface FB which faces a different direction from the first surface FA on which the liquid holes Da1, Da2, Ea1, and Ea2 are disposed. Therefore, when the external cover portion 41 of the liquid discharging head 20 is connected to the apparatus main body 101, it is possible to suppress the ink dribbling from the liquid holes Da1, Da2, Ea1, and Ea2 and entering the gas hole Ba. Even if the ink dribbles from the liquid holes Da1, Da2, Ea1, and Ea2 onto the first surface FA, since the ink does not easily move to the gas hole Ba which is disposed on the second surface FB which faces a different direction from the first surface FA, the ink does not easily enter the gas hole Ba. Additionally, since the gas holes Ba for creating an opening to the atmosphere and the gas holes Aa1 and Aa2 for carrying the gas using the gas carrying mechanism 19 are disposed separately in the external cover portion 41, it is possible to suppress the ink being pushed into the gas hole Ba due to the gas carrying mechanism 19 being driven even if the ink dribbles in the vicinity of the gas hole Ba.

The liquid hole Da1, the gas hole Aa1, the liquid hole Ea1, the liquid hole Da2, the gas hole Aa2, and the liquid hole Ea2 are arranged on a straight line along a virtual straight line G from the positive side to the negative side in the X direction in this order. Therefore, it is easy to reduce the size of the liquid discharging head 20 in the Y direction which intersects the X direction of the virtual straight line G. Although a case is exemplified in which the gas hole Ba for creating an opening to the atmosphere which is disposed on the second surface FB communicates with the gas flow path B for opening the pressurizing chamber RC to the atmosphere, the configuration is not limited thereto. The gas hole Ba for creating an opening to the atmosphere may be a gas hole which communicates with the gas flow path for communicating the space in which the damper chamber SG and the piezoelectric element 484 of the compliance substrate 452 are stored to the atmosphere, for example. The configuration is not limited to the case which is exemplified in FIG. 4, and a gas hole which blows away or sucks up waste such as fluff and paper powder in the vicinity of the nozzle N, for example, may be used as the gas hole for carrying the gas. A check valve may be provided in each of the liquid holes Da1, Da2, Ea1, and Ea2. Accordingly, it is possible to suppress the ink inside the liquid discharging head 20 flowing out from the liquid holes Da1, Da2, Ea1, and Ea2.

Incidentally, in the first surface FA of the head-side connecting portion 412 of FIG. 4, when a region in which the gas hole Aa1, the liquid hole Da1, and the liquid hole Ea1 are disposed is set to Ha and a region in which the main body-side gas hole Ab1, the main body-side liquid hole Db1, and the main body-side liquid hole Eb1 are disposed is set to Hb, the intervals of the region Ha and the region Hb are equal. The intervals of the liquid hole Da1 and the liquid hole Ea1 with respect to the gas hole Aa1 of the region Ha are equal to the intervals of the liquid hole Da2 and the liquid hole Ea2 with respect to the gas hole Aa2 of the region Hb in the direction of the virtual straight line G. Therefore, it is possible to connect the single liquid discharging head 20 to any position of the main body side connecting portion 102 in which the three liquid discharging heads 20 are disposed. In FIG. 4, although a case is exemplified in which the two regions Ha and Hb which correspond to every two liquid discharge units 44 are included on the first surface FA of the head-side connecting portion 412, the configuration is not limited thereto. For example, it is possible to adopt a configuration in which the first surface FA of the head-side connecting portion 412 includes a plurality of regions corresponding to the plurality of liquid discharge units 44, the liquid holes and the gas holes are disposed for each of the plurality of regions, the interval between the liquid holes and the gas holes in the direction of a straight line in a predetermined region of a plurality of regions is equal to the interval between the liquid holes and the gas holes in the direction of the virtual straight line G in the other regions, and the intervals of each region are equal. Accordingly, it is possible to dispose the main body-side liquid holes and the main body-side gas holes in any position of the main body side connecting portion 102 by providing a plurality of groups of the main body-side liquid holes and the main body-side gas holes of the main body side connecting portion 102 which is connected to the liquid holes and the gas holes.

The gas holes and the liquid holes which are disposed on the head-side connecting portion 412 are not limited to the case illustrated in FIG. 4. The gas holes and the liquid holes which are disposed on the head-side connecting portion 412 may include dummy holes which are not used. For example, in the first modification example of the first embodiment illustrated in FIG. 5, a case is exemplified in which the liquid hole Ea1 and the gas hole Aa2 of FIG. 4 are dummy holes. In this case, since the liquid holes Ea1 and the gas hole Aa2 are not used, protrusion portions P may be disposed at the positions of the liquid hole Ea1 and the gas hole Aa2, where the protrusion portions P block the main body-side liquid hole Eb1 and the main body-side gas hole Ab2 which correspond to the liquid hole Ea1 and the gas hole Aa2. According to the configuration of FIG. 5, even if the main body side connecting portion 102 of FIG. 4 is not re-manufactured to match the configuration of the head-side connecting portion 412 (even if a configuration is not adopted in which the main body-side liquid hole Eb1 and the main body-side gas hole Ab2 are not formed), it is possible to suppress the entrance of the ink into the gas hole.

Figure 5:
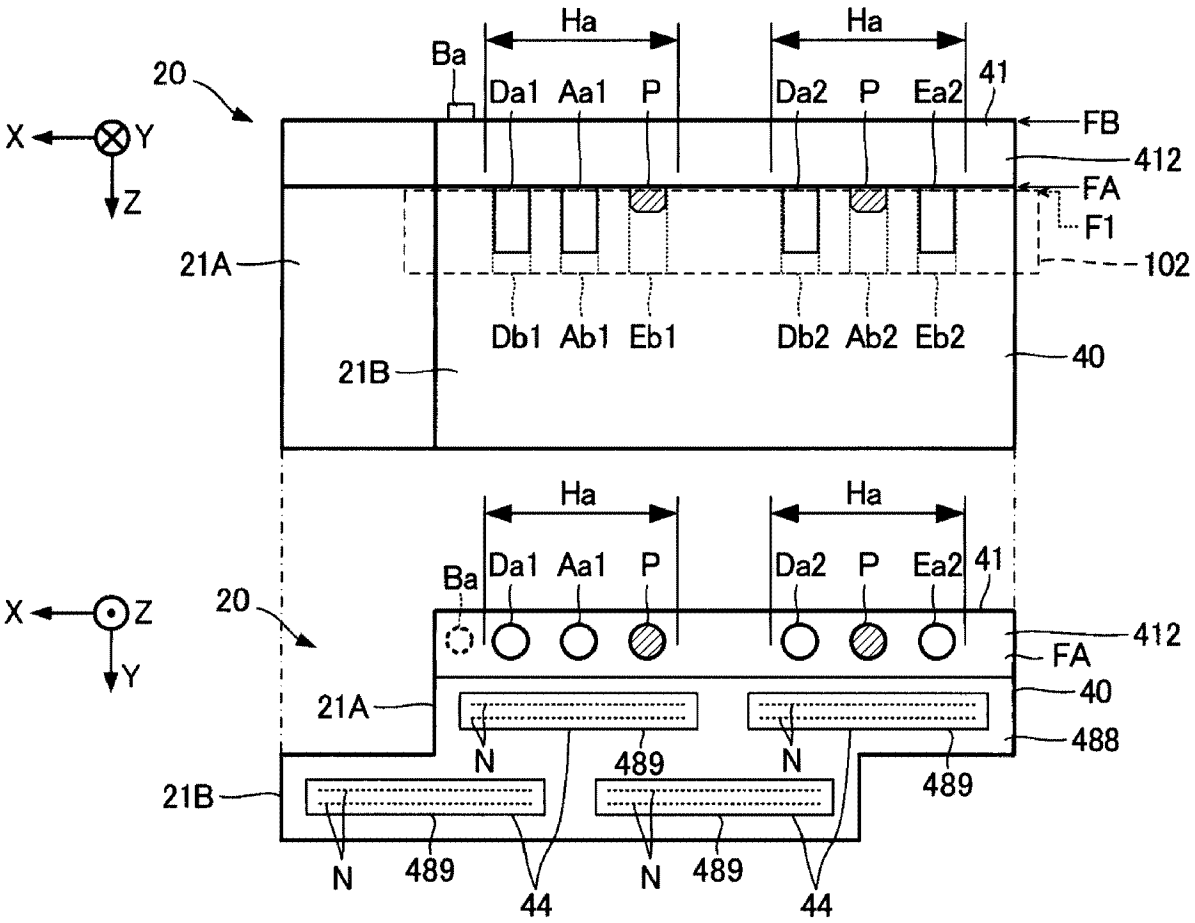
FIG. 5 shows a side view and a bottom view of a liquid discharging head according to a first modification example of the first embodiment.

According to the configuration of FIG. 5, since the liquid hole Ea2 for circulating the liquid is disposed at an endmost portion of the virtual straight line G, it is possible to simplify the routing of the liquid flow path D which communicates with the liquid hole Ea2. In FIG. 5, although a case is exemplified in which the liquid hole Ea2 for circulating the liquid is disposed on the same first surface FA as the liquid hole Da1 and the liquid hole Da2 for carrying the liquid, the configuration is not limited thereto. Of the first surface and the second surface (the first surface is not limited to FA and the second surface is not limited to FB) of mutually different directions of the external cover portion 41, the liquid hole Da1 and the liquid hole Da2 for carrying the liquid may be disposed on one, and the liquid hole Ea2 for circulating the liquid may be disposed on the other. In this configuration, it is possible to simplify the routing of the liquid flow path D which communicates with the liquid hole Ea2.

Figure 6:
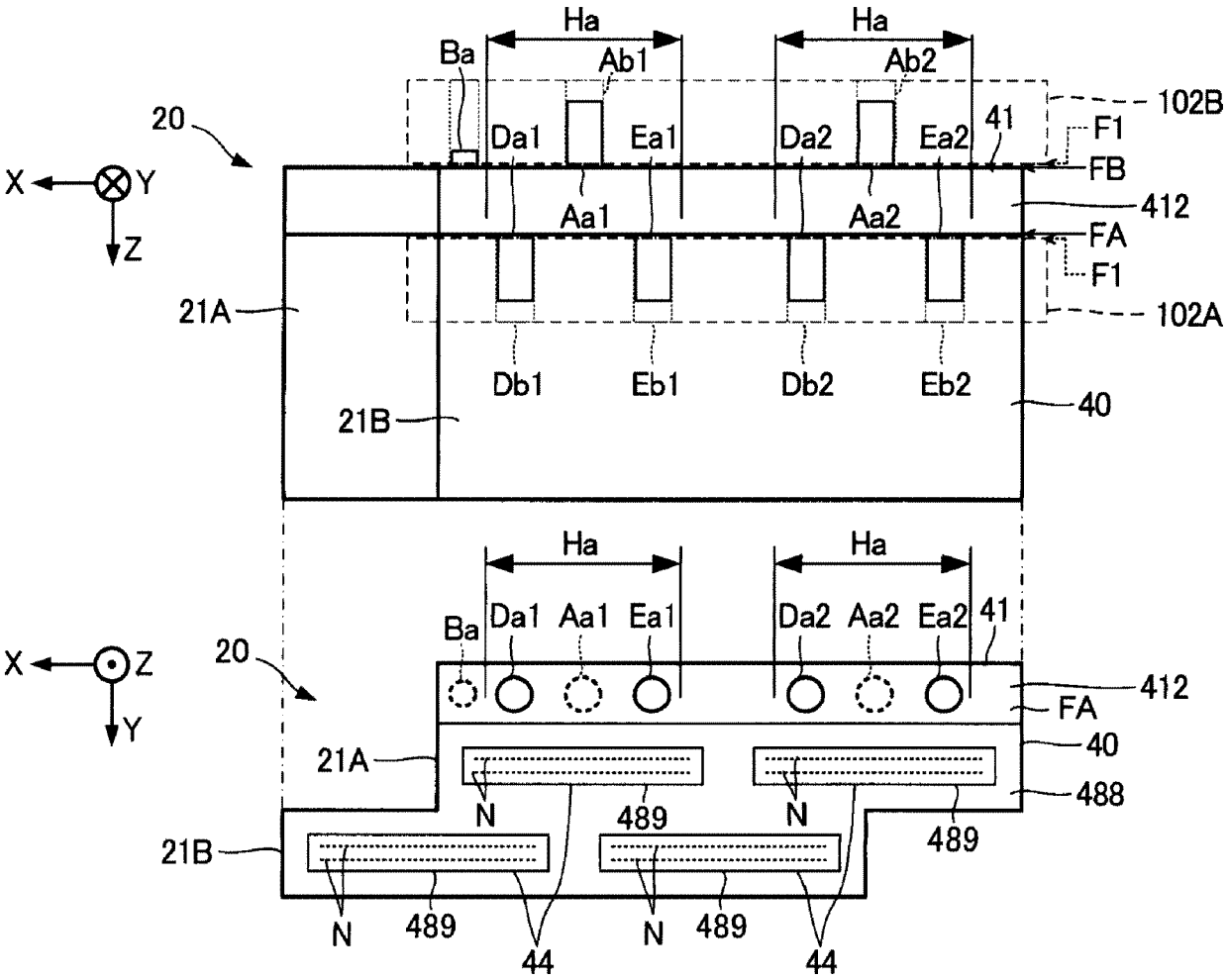
FIG. 6 shows a side view and a bottom view of a liquid discharging head according to a second modification example of the first embodiment.

In FIG. 4, although a case is exemplified in which the gas holes and the liquid holes are disposed on the same surface of the external cover portion 41, a configuration may be adopted in which the gas holes and the liquid holes are disposed separately on different surfaces of the external cover portion 41. For example, in the second modification example of the first embodiment illustrated in FIG. 6, a case is exemplified in which the liquid holes Da1, Da2, Ea1, and Ea2 are disposed on the first surface FA of the head-side connecting portion 412 and the gas holes Aa1 and Aa2 are disposed on the second surface FB. In the configuration of FIG. 6, the main body side connecting portion 102 is configured to be divided into a main body side connecting portion 102A which connects to the first surface FA of the head-side connecting portion 412 and a main body side connecting portion 102B which connects to the second surface FB. The main body-side liquid holes Db1, Db2, Eb1, and Eb2 are disposed on the connecting surface F1 of the main body side connecting portion 102A, and the main body-side gas holes Ab1 and Ab2 are disposed on the connecting surface F2 of the main body side connecting portion 102B.

According to the configuration of FIG. 6, when connecting the external cover portion 41 of the liquid discharging head 20 to the apparatus main body 101, by connecting the connecting surface F1 of the main body side connecting portion 102 to the first surface FA of the head-side connecting portion 412, it is possible to connect the liquid holes Da1, Da2, Ea1, and Ea2 to the main body-side liquid holes Db1, Db2, Eb1, and Eb2, respectively, at once. By connecting the connecting surface F2 of the main body side connecting portion 102 to the second surface FB of the head-side connecting portion 412, it is possible to connect the gas holes Aa1 and Aa2 to the main body-side gas holes Ab1 and Ab2, respectively, at once. In the configuration of FIG. 6, since the gas holes Aa1 and Aa2 are disposed on the second surface FB which faces a different direction from the first surface FA on which the liquid holes Da1, Da2, Ea1, and Ea2 are disposed, even if the ink dribbles onto the first surface FA from the liquid holes Da1, Da2, Ea1, and Ea2 when connecting the connecting surface F1 to the first surface FA, the ink does not move easily to the gas holes Aa1 and Aa2 of the second surface FB. Therefore, it is possible to suppress the entrance of the ink into the plurality of gas holes Aa1 and Aa2.

Figure 7:
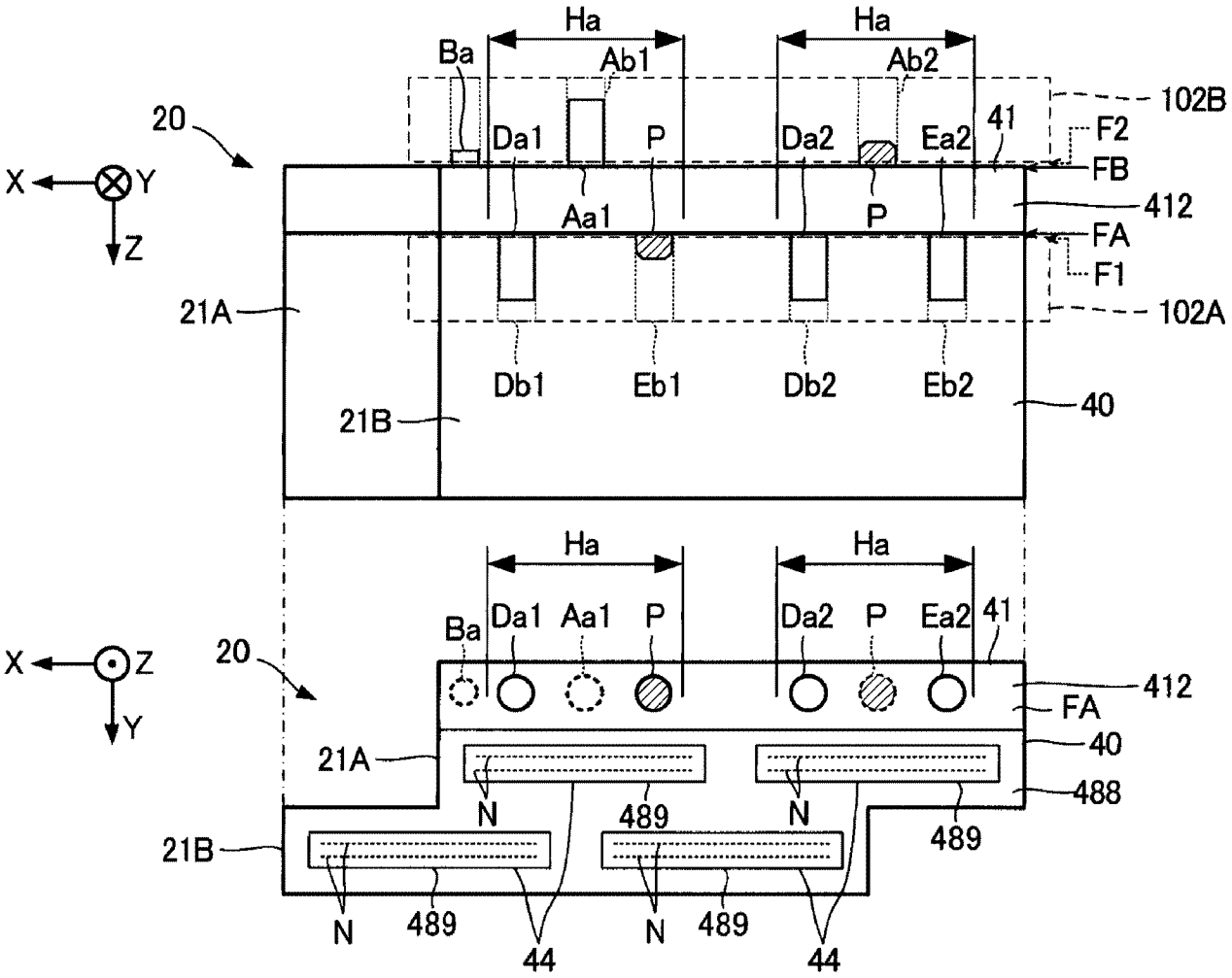
FIG. 7 shows a side view and a bottom view of a liquid discharging head according to a third modification example of the first embodiment.

Even in the configuration of FIG. 6, the gas holes and the liquid holes which are disposed on the head-side connecting portion 412 may include dummy holes which are not used in the same manner as in the case of FIG. 5. For example, in the third modification example of the first embodiment illustrated in FIG. 7, a case is exemplified in which the liquid hole Ea1 and the gas hole Aa2 of FIG. 7 are dummy holes. In this case, since the liquid holes Ea1 and the gas hole Aa2 are not used, protrusion portions P may be disposed at the positions of the liquid hole Ea1 and the gas hole Aa2, where the protrusion portions P block the main body-side liquid hole Eb1 and the main body-side gas hole Ab2 which correspond to the liquid hole Ea1 and the gas hole Aa2. According to the configuration of FIG. 7, even if the main body side connecting portions 102A and 102B of FIG. 6 are not re-manufactured to match the configuration of the head-side connecting portion 412 (even if a configuration is not adopted in which the main body-side liquid hole Eb1 and the main body-side gas hole Ab2 are not formed), it is possible to suppress the entrance of the ink into the gas hole.

In the line head 21 of the liquid discharging apparatus 10 of FIG. 1 which is described above, although a case is exemplified in which three of the liquid discharging heads 20 of FIG. 4 which have the same configuration are installed on the apparatus main body 101, the configuration is not limited thereto, and the liquid discharging heads 20 which have different configurations may be installed together on the apparatus main body 101. For example, when the liquid discharging head 20 of FIG. 4 is a first liquid discharging head 20A and the liquid discharging head 20 of FIG. 5 is a second liquid discharging head 20B, in the fourth modification example of the first embodiment illustrated in FIG. 8, the first liquid discharging head 20A and the second liquid discharging head 20B are both connected to the main body side connecting portion 102 of the apparatus main body 101. As described above, since it is possible to connect the head-side connecting portion 412 of FIGS. 4 and 5 to the main body side connecting portion 102 of FIG. 4, it is possible to connect both the first liquid discharging head 20A of FIG. 4 and the second liquid discharging head 20B of FIG. 5 to the apparatus main body 101.

Figure 8:
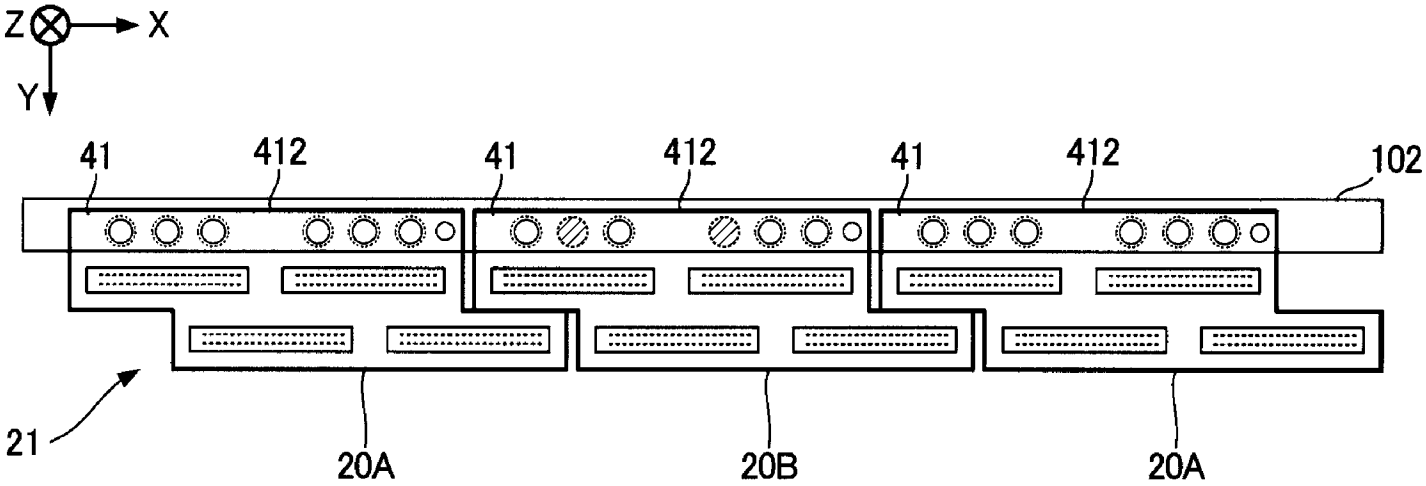
FIG. 8 is a plan view of a line head according to a fourth modification example of the first embodiment.

According to the configuration of FIG. 8, as the manufacturing method of the liquid discharging apparatus 10, it is possible to include a process of removing one of the first liquid discharging head 20A and the second liquid discharging head 20B which are installed on the apparatus main body 101 and exchanging the removed head for the other head. In the exchanging process, the liquid hole (Da1 or the like) is connected to the corresponding main body-side liquid hole (Db1 or the like) while the gas hole (Aa1 or the like) of the other head is connected to the corresponding main body-side gas hole (Ab1 or the like). Therefore, it is possible to easily manufacture the liquid discharging apparatus 10 which is provided with the line head 21 which has a different overall configuration while suppressing the entrance of the ink into the gas holes by merely exchanging the heads in the exchanging process. Naturally, a configuration may be adopted in which only one of the first liquid discharging head 20A and the second liquid discharging head 20B is connected to the apparatus main body 101 to manufacture the liquid discharging apparatus 10.

The exchanging of the heads in the exchanging process may be performed by an operator and may be performed automatically by a robot arm or the like. In this case, in the liquid discharging apparatus 10, a configuration may be adopted in which information of the types and the installable positions of the exchangeable liquid discharging heads 20 is stored in a memory device and the exchanging process is performed based on the stored information. In this configuration, in the liquid discharging apparatus 10, it is possible to suppress the unintended installation of the liquid discharging head 20 of a type which cannot be exchanged and the installation at a deviated position. For example, the types of the installable heads such as the liquid discharging heads 20A and 20B illustrated in FIG. 8 are examples of the information of the types of the exchangeable liquid discharging head 20. For example, the information of positions at which it is possible to connect the liquid discharging heads 20 to the main body side connecting portion 102 is an example of the information of the positions of the installable liquid discharging heads 20.

Figure 9:
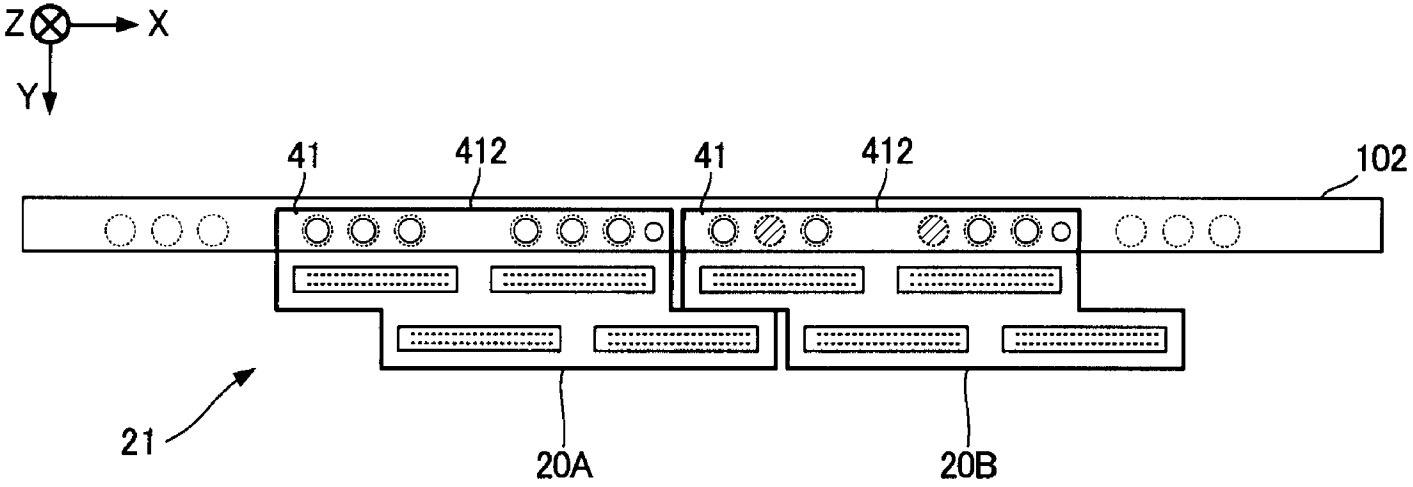
FIG. 9 is a plan view of a line head according to a fifth modification example of the first embodiment.

Regarding the positions of the liquid discharging heads 20, as in the fifth modification example of the first embodiment illustrated in FIG. 9, it is possible to adopt a configuration in which it is possible to connect the liquid discharging head 20A and the liquid discharging head 20B to the main body side connecting portion 102 deviated at different positions from the line head 21 of FIG. 1. In FIG. 9, although a case is exemplified in which a configuration is adopted in which both of the different liquid discharging heads 20A and 20B can be used together, the configuration is not limited thereto, and it is possible to adopt a configuration in which the number of the liquid discharging heads 20 of the same configuration may be changed and the positions thereof may be shifted. In this manner, it is possible to easily manufacture the liquid discharging apparatus 10 which is provided with the line head 21 with a different printable range by changing the number and positions of the liquid discharging heads 20.

Figure 10:
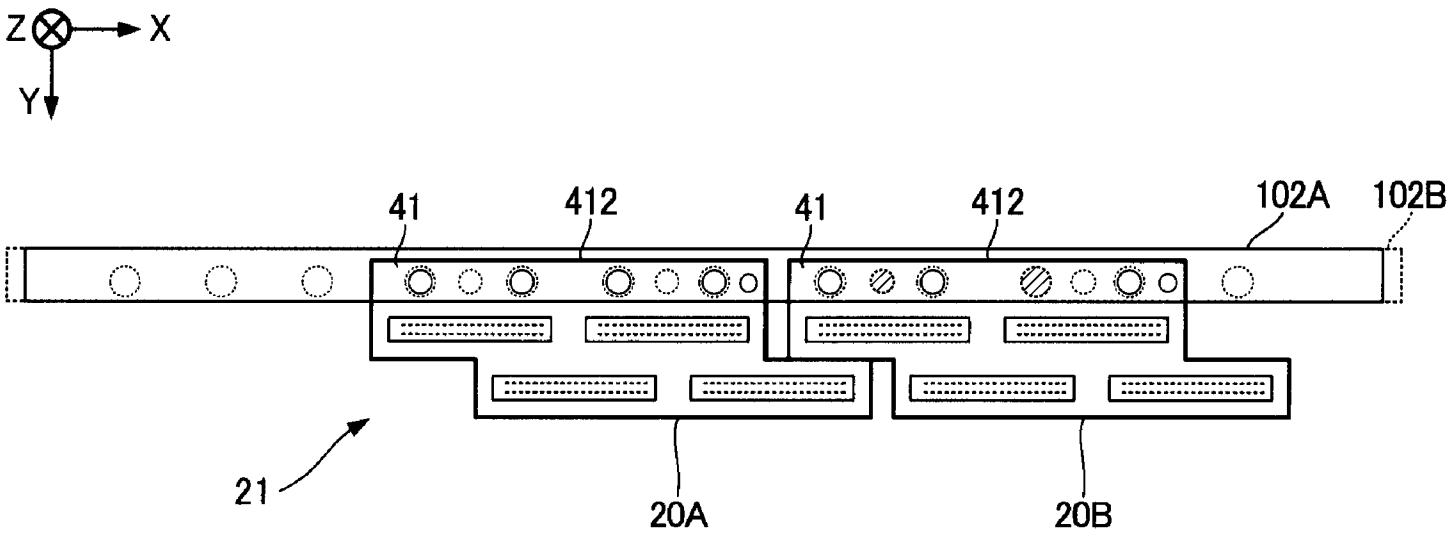
FIG. 10 is a plan view of a line head according to a sixth modification example of the first embodiment.

Hereinabove, although a case is exemplified in which the liquid discharging heads 20 of the configurations of FIGS. 4 and 5 are configured such that they may be used together, a configuration may be adopted in which the liquid discharging heads 20 of FIGS. 6 and 7 may be used together. For example, when the liquid discharging head 20 of FIG. 6 is the first liquid discharging head 20A and the liquid discharging head 20 of FIG. 5 is the second liquid discharging head 20B, in the fifth modification example of the first embodiment illustrated in FIG. 10, the first liquid discharging head 20A and the second liquid discharging head 20B are both connected to the main body side connecting portions 102A and 102B of the apparatus main body 101.

Second Embodiment

A description will be given of the second embodiment of the invention. Regarding the elements of the operations and functions of the embodiments to be exemplified hereinafter that are similar to those in the first embodiment, the reference numerals which are used in the description of the first embodiment will be reused and detailed description of the elements will be omitted, as appropriate. For the liquid discharging head 20 of the first embodiment, a case is exemplified in which four of the liquid discharging units 44 are provided and the two regions Ha and Hb which correspond to every two of the liquid discharge units 44 are present on the first surface FA of the head-side connecting portion 412. For the liquid discharging head 20 of the second embodiment, a case is exemplified in which two of the liquid discharging units 44 are provided and the one region Ha which corresponds to two of the liquid discharge units 44 is present on the first surface FA of the head-side connecting portion 412.

Figure 11:
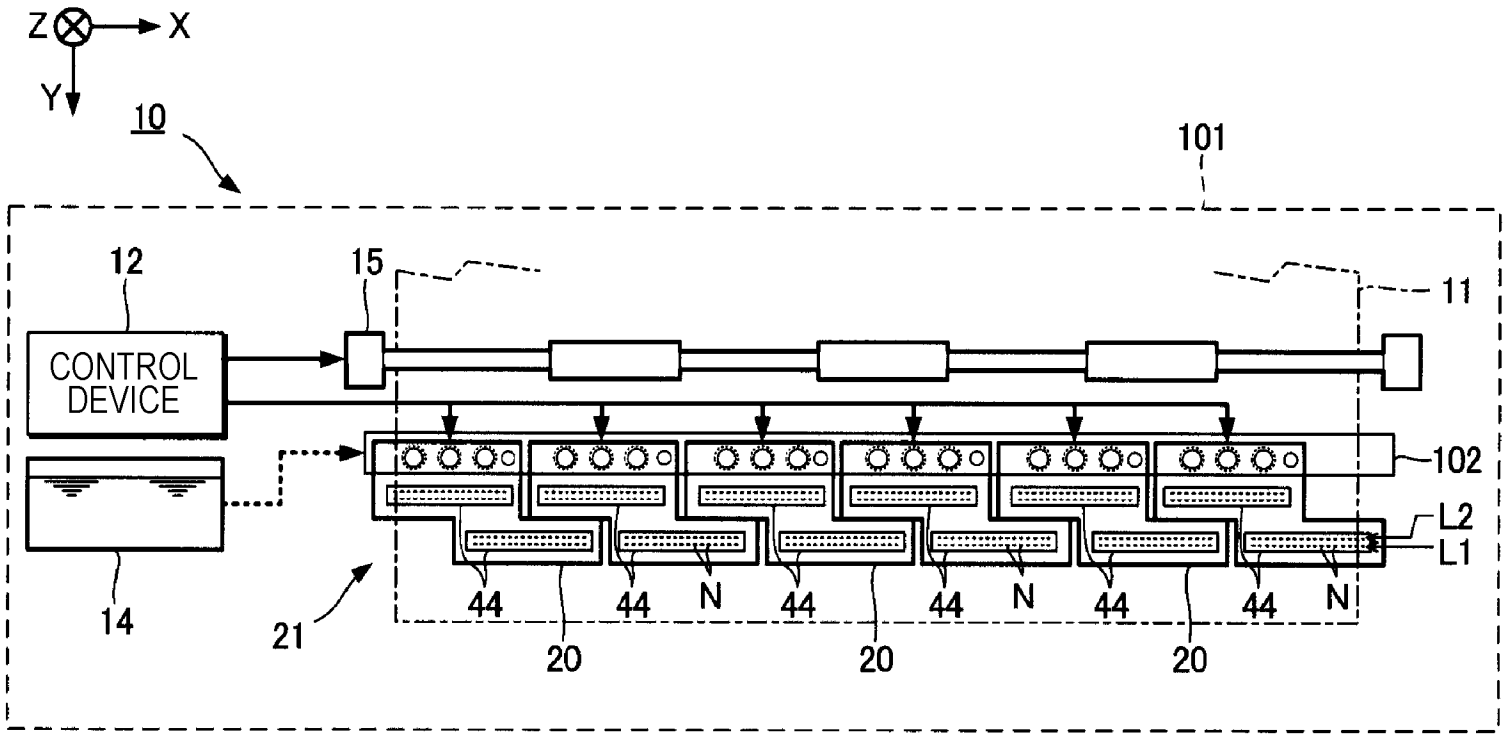
FIG. 11 is a configuration diagram of a liquid discharging apparatus according to a second embodiment.
Figure 12:
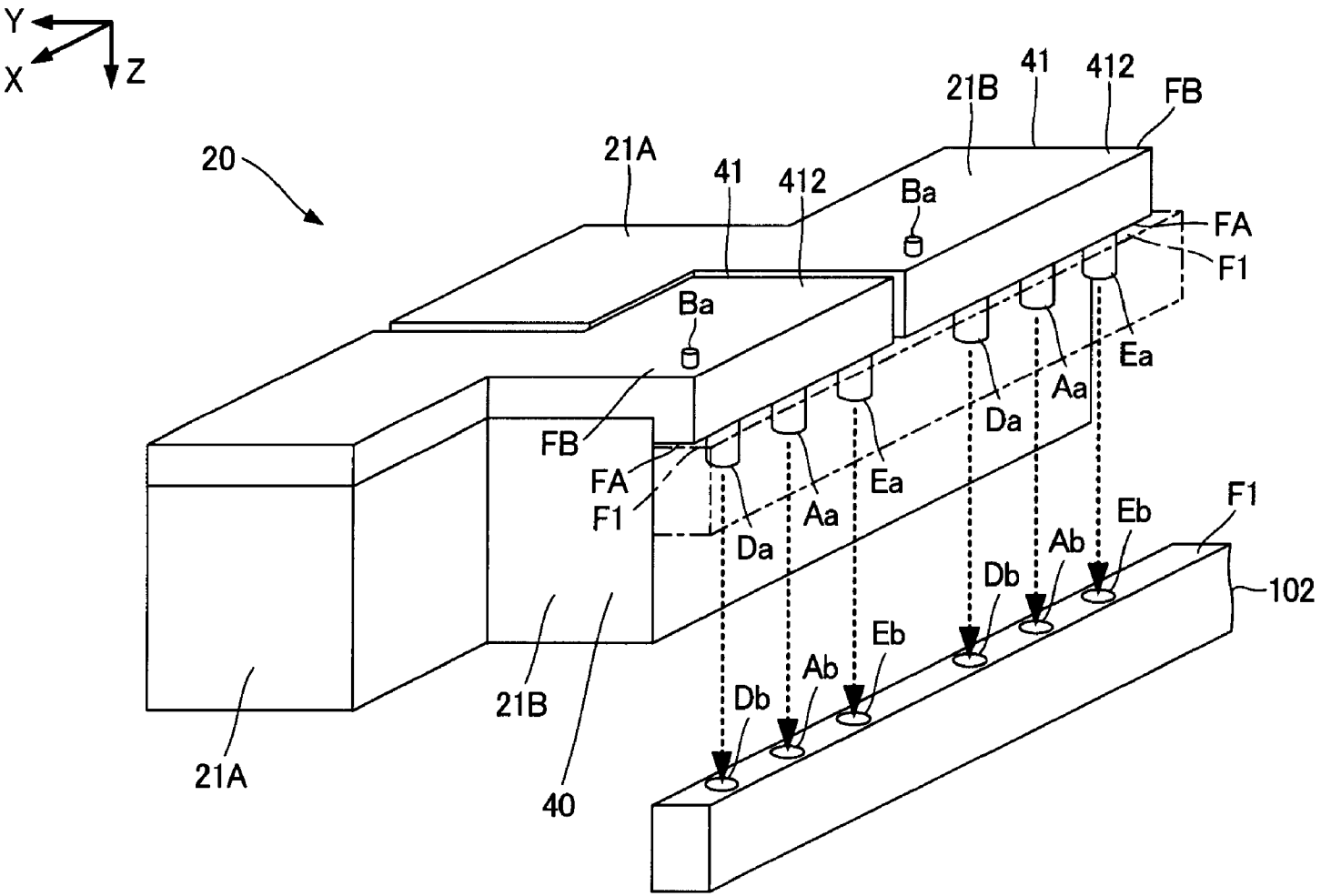
FIG. 12 is a perspective view illustrating an external configuration of one liquid discharging head from among those illustrated in FIG. 11.
Figure 13:
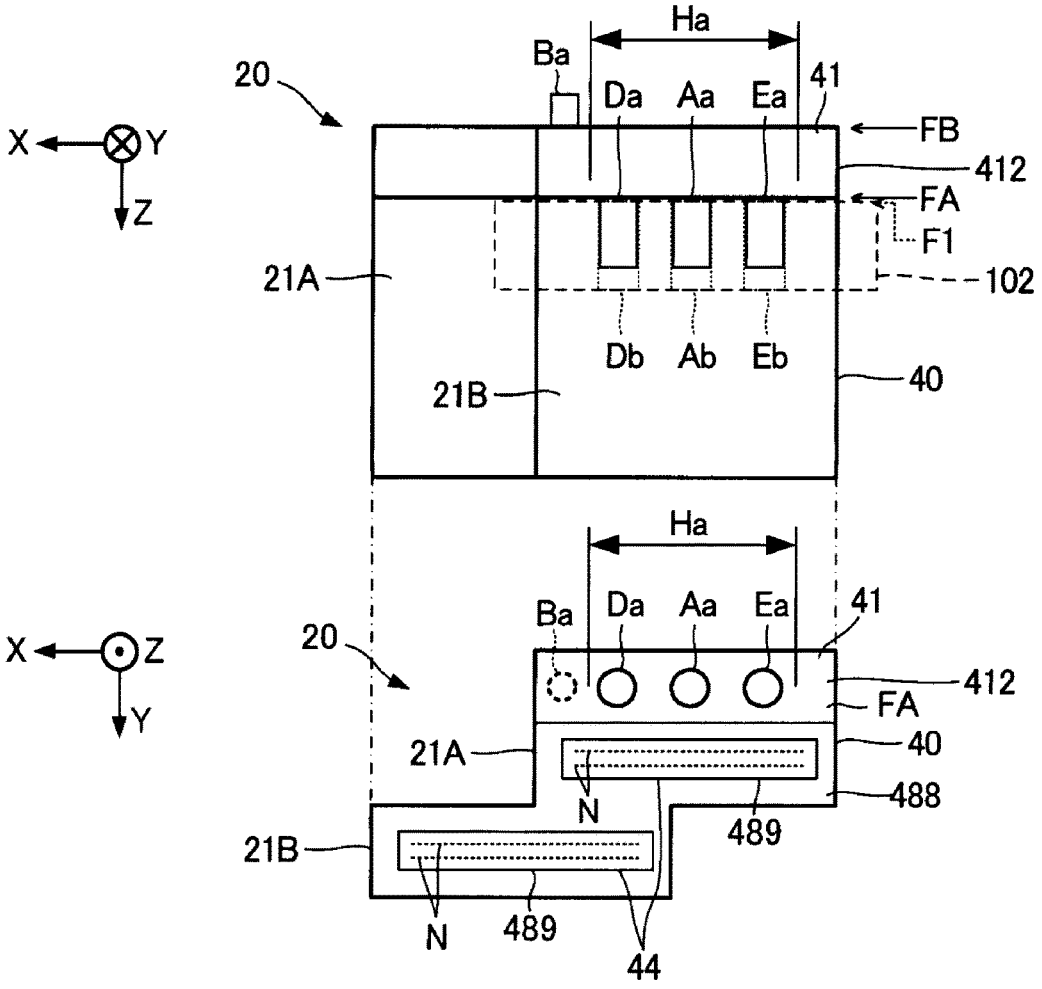
FIG. 13 shows a side view and a bottom view of the liquid discharging head illustrated in FIG. 12.

FIG. 11 is a partial configuration diagram of the liquid discharging apparatus 10 according to the second embodiment. FIG. 12 is a perspective view illustrating an external configuration of one of the liquid discharging heads 20 which configure the line head 21 of the second embodiment. FIG. 13 shows a side view and a bottom view of the liquid discharging head 20 of the second embodiment, respectively. In FIG. 12, the main body side connecting portion 102 before the liquid discharging head 20 is installed is indicated using a solid line and the main body side connecting portion 102 after the liquid discharging head 20 is installed is indicated using a dot-dash line. As illustrated in FIGS. 11 to 13, the liquid discharging head 20 of the second embodiment is obtained by dividing the liquid discharging head 20 of the first embodiment into two in the X direction, and a similar configuration as that of the liquid discharging head 20 of the first embodiment is achieved by two of the liquid discharging heads 20 of the second embodiment. In other words, as illustrated in FIG. 13, in the liquid discharging heads 20 of the second embodiment, the liquid hole Da for carrying the liquid, the gas hole Aa for carrying the gas, and the liquid hole Ea for circulating the liquid are disposed, in this order, on a straight line along the virtual straight line G from the positive side to the negative side in the X direction in the region Ha of the first surface FA of the head-side connecting portion 412.

As illustrated in FIG. 11, in the second embodiment, six of the liquid discharging heads 20 are connected to the same main body side connecting portion 102 which is the same as the one in FIG. 1. Therefore, since the combinations in which the number and the positions of the liquid discharging heads 20 increase to a greater number than in the first embodiment, it is possible to easily manufacture the liquid discharging apparatus 10 which is provided with more types of the line head 21 than in the first embodiment.

Figure 14:
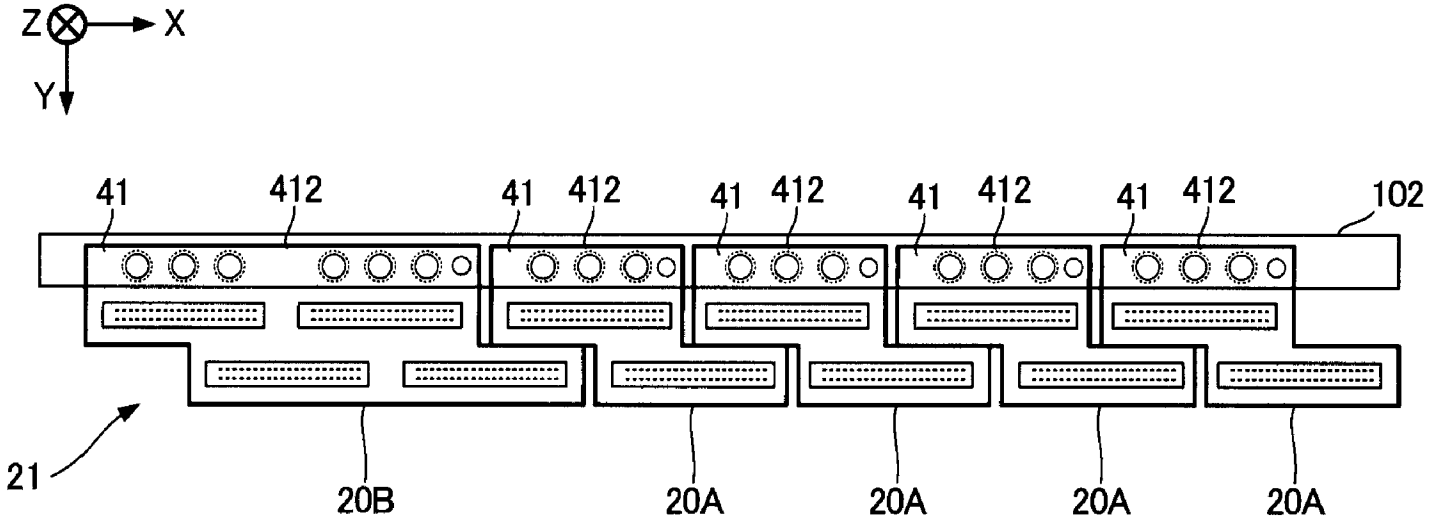
FIG. 14 is a plan view of a line head according to a modification example of the second embodiment.

In FIG. 11, although a case is exemplified in which six of the same liquid discharging heads 20 of FIG. 13 are connected, the configuration is not limited thereto. Since the main body side connecting portion 102 of FIG. 11 has the same configuration as in FIG. 1, it is also possible to connect the liquid discharging head 20 of FIGS. 4 and 5. Therefore, if the liquid discharging head 20 of FIG. 13 is the first liquid discharging head 20A and the liquid discharging head 20 of FIG. 4 is the second liquid discharging head 20B, as in the modification example of the second embodiment illustrated in FIG. 14, it is possible to connect both the first liquid discharging head 20A of FIG. 13 and the second liquid discharging head 20B of the FIG. 5 to the main body side connecting portion 102 of FIG. 11. Therefore, the number of the gas holes of a predetermined liquid discharging head 20 of the plurality of liquid discharging heads 20 may be set to a different number from that of the gas holes of another liquid discharging head. In this manner, it is possible to connect a mixture of the liquid discharging heads 20 in which the number of the gas hole or the liquid holes is different to the main body side connecting portion 102.

Third Embodiment

Figure 15:
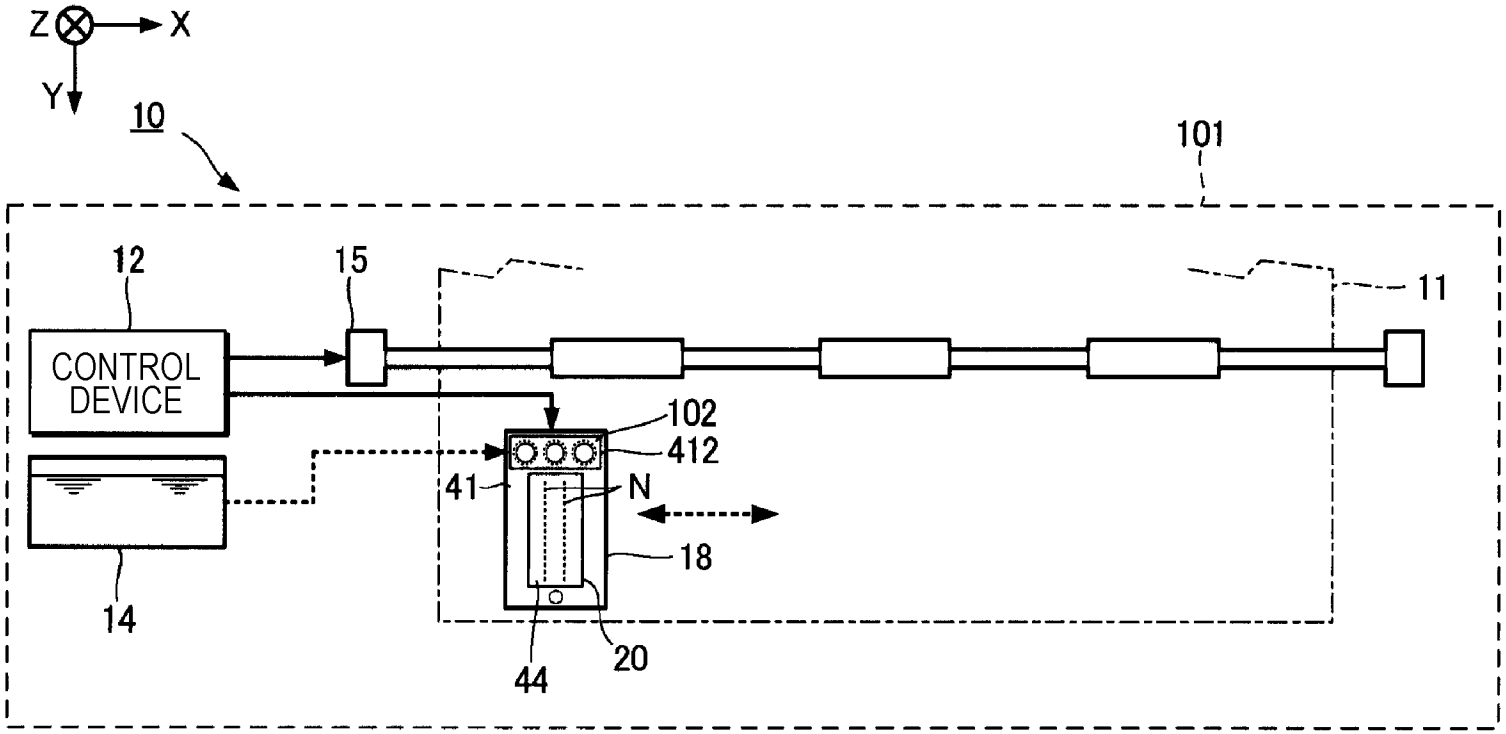
FIG. 15 is a configuration diagram of a liquid discharging apparatus according to a third embodiment.
Figure 16:
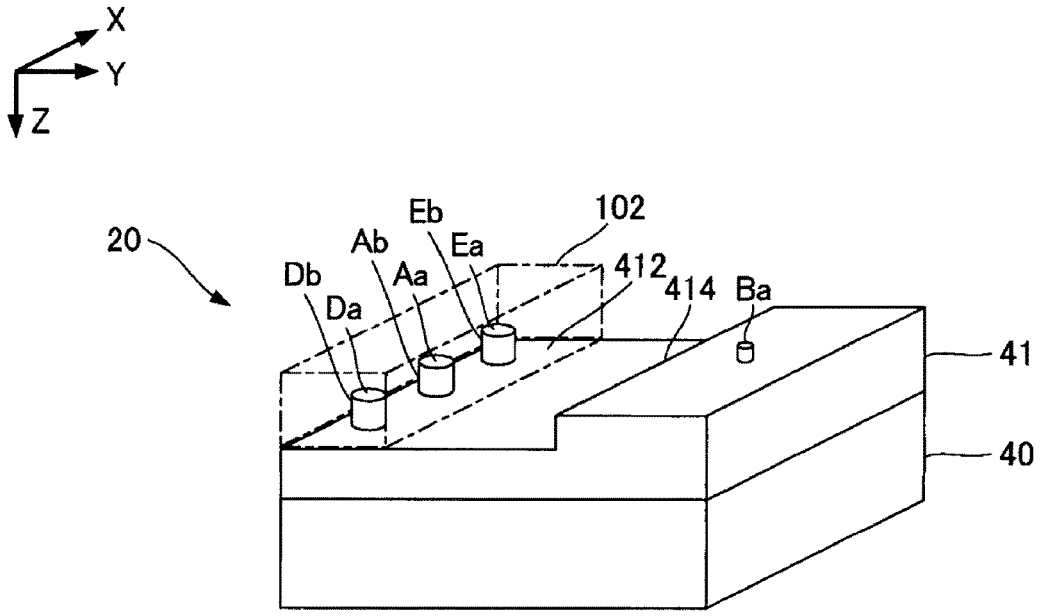
FIG. 16 is a perspective view illustrating an external configuration of the liquid discharging head illustrated in FIG. 15.

A description will be given of the third embodiment of the invention. In the first embodiment and the second embodiment, the line head 21 in which the liquid discharging heads 20 are arranged along the entire width of the medium 11 is exemplified. In the third embodiment, a serial head which causes a carriage 18 on which the liquid discharging head 20 is mounted to repeatedly move reciprocally along the X direction is exemplified. FIG. 15 is a partial configuration diagram of the liquid discharging apparatus 10 according to the third embodiment. FIG. 16 is a perspective view illustrating an external configuration of the liquid discharging head 20 of the third embodiment.

As illustrated in FIG. 15, the liquid discharging head 20 of the third embodiment is mounted on the substantially box-shaped carriage 18 and discharges the ink which is supplied from the liquid container 14 onto the medium 11 under the control of the control device 12. The control device 12 causes the carriage 18 to move reciprocally along the X direction which intersects the Y direction. A desired image is formed on the surface of the medium 11 by the liquid discharging head 20 discharging the ink onto the medium 11 in parallel with the transporting of the medium 11 by the transport mechanism 15 and the repeated reciprocal movement of the carriage 18. It is possible to mount the liquid container 14 on the carriage 18 together with the liquid discharging head 20.

As illustrated in FIG. 16, the liquid discharging head 20 of the third embodiment is provided with the single liquid discharge unit 44. Since the cross-sectional configuration of the liquid discharging head 20 of FIG. 16 is substantially the same as in FIG. 3, detailed description thereof will be omitted. The liquid discharging head 20 of FIG. 16 is configured such that the top surface (the surface of the negative side in the Z direction) of the external cover portion 41 is the head-side connecting portion 412. The liquid hole Da for carrying the liquid, the gas hole Aa for carrying the gas, and the liquid hole Ea for circulating the liquid are disposed, in this order, on a straight line from the positive side to the negative side in the X direction of the head-side connecting portion 412. Therefore, even in the liquid discharging head 20 of the third embodiment, it is possible to suppress the ink dribbling and entering the gas hole Aa when connecting the head-side connecting portion 412 to the main body side connecting portion 102.

The gas hole Ba for creating an opening to the atmosphere is also disposed on the head-side connecting portion 412. A level difference 414 is formed between the gas hole Ba for creating an opening to the atmosphere, and the liquid hole Da, the gas hole Aa, and the liquid hole Ea. Therefore, even if the ink dribbles from the liquid holes Da and Ea, since the level difference 414 gets in the way, the ink does not easily move to the gas hole Ba. Therefore, it is possible to suppress the entrance of the ink into the gas hole Ba.

Modification Example

The aspects and embodiments which are exemplified above may be modified in various manners. Specific modified aspects will be exemplified hereinafter. Two or more aspects selected arbitrarily from the following examples and the above-described aspects may be combined, as appropriate, insofar as there is no mutual contradiction.

(1) In the embodiments, although a piezoelectric type of the liquid discharging head 20 which uses piezoelectric elements to apply mechanical vibrations to pressure chambers is exemplified, it is also possible to adopt a heat type liquid discharging head which uses heat generating elements which generate bubbles in the inner portions of pressure chambers using heat.

(2) For the liquid discharging apparatus 10 which is exemplified in the embodiments, in addition to a device which is dedicated to printing, it is possible to adopt various devices such as a facsimile device or a copier device. Naturally, the usage of the liquid discharging apparatus 10 of the invention is not limited to printing. For example, the liquid discharging apparatus which discharges a colorant solution is used as a manufacturing apparatus which forms color filters of a liquid crystal display device, organic electroluminescence (EL) displays, field emission displays (FED), and the like. The liquid discharging apparatus which discharges a solution of a conductive material is used as a manufacturing apparatus which forms the wiring and the electrodes of a wiring substrate. The liquid discharging apparatus is also used as a chip manufacturing apparatus which discharges a solution of biological organic matter as a type of liquid.

The entire disclosure of Japanese Patent Application Nos. 2017-127125, filed Jun. 29, 2017 and 2018-13727, filed Jan. 30, 2018 are expressly incorporated by reference herein.

What is claimed is:

1. A liquid discharging head comprising an external cover portion which is connected to a liquid discharging apparatus and which discharges a liquid from a nozzle, wherein the external cover portion includes a first gas hole for communicating a first gas flow path which is provided inside the external cover portion with an atmosphere, a second gas hole for carrying a gas between a second gas flow path which is provided inside the external cover portion and the liquid discharging apparatus, and a first liquid hole for carrying the liquid between a liquid flow path which is provided inside the external cover portion and the liquid discharging apparatus, and wherein the first gas hole and the second gas hole are disposed separately in the external cover portion.

2. The liquid discharging head according to claim 1,
wherein the external cover portion includes a first surface, and
wherein the second gas hole and the first liquid hole are disposed on the first surface.

3. The liquid discharging head according to claim 2,
wherein the second gas hole and the first liquid hole are arranged on a straight line.

4. The liquid discharging head according to claim 1,
wherein a level difference is provided between the first gas hole and the first liquid hole.

5. The liquid discharging head according to claim 1,
wherein the external cover portion includes a first surface and a second surface facing different directions from each other, and
wherein, of the first surface and the second surface, the first gas hole is disposed on one and the first liquid hole is disposed on the other.

6. The liquid discharging head according to claim 1, further comprising:
a second liquid hole for returning the liquid from the liquid discharging head to the liquid discharging apparatus,
wherein the first liquid hole and the second liquid hole are arranged on a straight line, and
wherein the second liquid hole is disposed at an end portion on the straight line.

7. The liquid discharging head according to claim 1, further comprising:
a second liquid hole for returning the liquid from the liquid discharging head to the liquid discharging apparatus,
wherein the external cover portion includes a first surface and a second surface facing different directions from each other, and
wherein, of the first surface and the second surface, the first liquid hole is disposed on one and the second liquid hole is disposed on the other.

8. The liquid discharging head according to claim 1,
wherein a plurality of the second gas holes are provided,
wherein the external cover portion includes a first surface, and
wherein the plurality of second gas holes are disposed on the first surface.

9. The liquid discharging head according to claim 8,
wherein a plurality of the first liquid holes are provided, and
wherein the plurality of first liquid holes and the plurality of second gas holes are disposed on the first surface.

10. The liquid discharging head according to claim 9, further comprising:
a plurality of liquid discharge units which discharge the liquid,
wherein the first surface includes a plurality of regions corresponding to the plurality of liquid discharge units,
wherein the first liquid hole and the second gas hole are disposed in each of the plurality of regions, and
wherein an interval between the first liquid hole and the second gas hole in a direction of the straight line in a predetermined region of the plurality of regions is equal to an interval between the first liquid hole and the second gas hole in the direction of the straight line in the other regions.

11. The liquid discharging head according to claim 1, further comprising:
a check valve which communicates with first the liquid hole.

12. A liquid discharging apparatus comprising:
an apparatus main body to which the liquid discharging head according to claim 1 is connected,
wherein the apparatus main body includes
a main body-side second gas hole which is connected to the second gas hole, and
a main body-side first liquid hole which connects to the first liquid hole, and
wherein the first gas flow path communicates with an atmosphere.

13. A liquid discharging apparatus comprising:
an apparatus main body to which the liquid discharging head according to claim 2 is connected,
wherein the apparatus main body includes
a main body-side second gas hole which is connected to the second gas hole, and
a main body-side first liquid hole which connects to the first liquid hole, and
wherein the first gas flow path communicates with an atmosphere.

14. A liquid discharging apparatus comprising:
an apparatus main body to the liquid discharging head according to claim 3 is connected,
wherein the apparatus main body includes
a main body-side second gas hole which is connected to the second gas hole, and
a main body-side first liquid hole which connects to the first liquid hole, and
wherein the first gas flow path communicates with an atmosphere.

15. A liquid discharging apparatus comprising:
an apparatus main body to which the liquid discharging head according to claim 4 is connected,
wherein the apparatus main body includes
a main body-side second gas hole which is connected to the second gas hole, and
a main body-side first liquid hole which connects to the first liquid hole, and
wherein the first gas flow path communicates with an atmosphere.

16. A liquid discharging apparatus comprising:
an apparatus main body to which the liquid discharging head according to claim 5 is connected,
wherein the apparatus main body includes
a main body-side second gas hole which is connected to the second gas hole, and
a main body-side first liquid hole which connects to the first liquid hole, and
wherein the first gas flow path communicates with an atmosphere.

17. A liquid discharging apparatus comprising an apparatus main body to which a first liquid discharging head and a second liquid discharging head which are different from each other are connected,
wherein the first liquid discharging head and the second liquid discharging head each includes
a gas hole for carrying a gas to and from the apparatus main body using a gas carrying mechanism, and
a liquid hole for carrying the liquid to and from the apparatus main body using a liquid carrying mechanism, and
wherein the apparatus main body of the liquid discharging apparatus includes
a main body-side gas hole which connects to the gas hole, and
a main body-side liquid hole which connects to the liquid hole.

18. The liquid discharging apparatus according to claim 17, wherein the number of the gas holes of a predetermined liquid discharging head of the plurality of liquid discharging heads is different from the number of gas holes of another liquid discharging head.

19. The liquid discharging apparatus according to claim 17, wherein a position on the apparatus main body of a predetermined liquid discharging head of the plurality of liquid discharging heads is different from a position on the apparatus main body of another liquid discharging head.

20. A manufacturing method of a liquid discharging apparatus which includes an apparatus main body to which a first liquid discharging head and a second liquid discharging head are connected, in which the first liquid discharging head and the second liquid discharging head are different from each other, in which the first liquid discharging head and the second liquid discharging head each includes a gas hole for carrying a gas to and from the apparatus main body using a gas carrying mechanism, and a liquid hole for carrying the liquid to and from the apparatus main body using a liquid carrying mechanism, and in which the apparatus main body of the liquid discharging apparatus includes a main body-side gas hole which connects to the gas hole, and a main body-side liquid hole which connects to the liquid hole, the method comprising:

removing one head of the first liquid discharging head and the second liquid discharging head which are installed in the apparatus main body and exchanging the removed head for another head, wherein in the exchanging, the liquid hole is connected to the main body-side liquid hole while the gas hole of the other head is connected to the main body-side gas hole.

* * * * *